US012258116B2

(12) United States Patent
VanDyne

(10) Patent No.: US 12,258,116 B2
(45) Date of Patent: Mar. 25, 2025

(54) FORWARD PUSHING SAIL

(71) Applicant: Tetrahedron Racing, Inc., Loveland, CO (US)

(72) Inventor: Edward VanDyne, Fort Collins, CO (US)

(73) Assignee: Tetrahedron Racing, Inc., Loveland, CO (US)

( * ) Notice: Subject to any disclaimer, the term of this patent is extended or adjusted under 35 U.S.C. 154(b) by 486 days.

(21) Appl. No.: 17/688,995

(22) Filed: Mar. 8, 2022

(65) Prior Publication Data

US 2023/0286631 A1 Sep. 14, 2023

(51) Int. Cl.
*B63H 9/061* (2020.01)
*B63H 9/08* (2006.01)

(52) U.S. Cl.
CPC ..... *B63H 9/061* (2020.02); *B63H 9/08* (2013.01)

(58) Field of Classification Search
CPC . B63H 9/00; B63H 9/06; B63H 9/061; B63H 9/067; B63H 9/08
USPC ..... 114/39.21
See application file for complete search history.

(56) References Cited

U.S. PATENT DOCUMENTS

2022/0055725 A1 2/2022 Curchod

OTHER PUBLICATIONS

Corresponding Canadian Patent Application No. 3,167,094, Office action dated Nov. 20, 2023, 5 pages.

*Primary Examiner* — Lars A Olson
(74) *Attorney, Agent, or Firm* — Craig R. Miles; CR MILES P.C.

(57) ABSTRACT

The present invention provides a forward propulsion system for a wind driven vehicle which includes one or more of a mast or a mast sleeve having a pliant sheet coupler capable of orientation at a mast front with a pliant sheet extending from the pliant sheet coupler over either a mast first side or a mast second side to a connection behind the mast to achieve configurations which move the force vector of the airflow acting on the pliant sheet further toward the forward direction of the wind driven vehicle, as compared to conventional sail configurations, to increase forward thrust and forward velocity of the wind driven vehicle.

23 Claims, 12 Drawing Sheets

FORWARD PUSHING SAIL

I. FIELD OF THE INVENTION

The present invention provides a forward propulsion system for a wind driven vehicle which includes one or more of a mast or a mast sleeve having a pliant sheet coupler capable of orientation at a mast front with a pliant sheet extending from the pliant sheet coupler over either a mast first side or a mast second side to a connection behind the mast to achieve configurations which move the force vector of the airflow acting on the pliant sheet further toward the forward direction of the wind driven vehicle, as compared to conventional sail configurations, to increase forward thrust and forward velocity of the wind driven vehicle.

II. BACKGROUND OF THE INVENTION

Conventionally, a mast directly or indirectly couples in a general vertical orientation to a wind driven vehicle. Most masts are fixed in place with a sail connected at the back of the mast. The sail then extends to a connection on a boom which extends behind the mast. The term "back" means facing the stern (S) of the wind driven vehicle and is opposite the "front" meaning facing the bow (B) of the wind driven vehicle. Some masts or mast sleeves can rotate in order to improve the aerodynamics of the mast sail combination. These masts are designed to rotate based on the pull from the sail to one side of the boat or the other, in the direction opposite from the apparent wind (AW) direction. The mast or a mast sleeve disposed about the mast can rotate in each of a clockwise direction or a counter-clockwise direction about the mast longitudinal axis (MLA) of the mast through about 90 degrees from a zero-degree position in which the sail connection to the mast or the mast sleeve faces the stern (S) of the wind driven vehicle. The orientation of the sail connection to the mast or the mast sleeve from the zero-degree position depends on the forward direction of the wind driven vehicle relative to the direction of the true wind (TW). The true wind being the direction of the wind relative to a fixed point. The forward movement of the wind powered vessel further generates an apparent wind (AW) over the mast-sail combination.

In an illustrative example of sailboats, conventional mast-sail combinations can cause the sailboat to tip to the side because the wind acting on the sail generates thrust in a direction that pushes the sailboat over to one side to a greater extent than the wind pushes the sailboat forward. The tipping force (TF) can be countered with a keel which urges the sailboat toward an upright orientation. However, the keel can add significant weight to the sailboat whereby the sailboat may displace more water which correspondingly increases drag on the sailboat.

There would be an advantage in inventive mast-sail combinations having aerodynamics that increase the force vector of the mast sail combination. There would be an additional advantage in inventive mast-sail combinations that point the force vector further in the forward direction of the sailboat, or other wind driven vehicle, and correspondingly decrease the force vector acting to tip the sailboat to the side. The inventive sail configurations may further allow for a reduction in the keel size and weight, creating a corresponding reduction in drag on the sailboat which can afford an increase in the forward velocity of the sailboat, or other wind driven vehicle.

III. SUMMARY OF THE INVENTION

Accordingly, the invention encompasses improvements in sail or mast-sail combinations that move the force vector forward or increase the magnitude of force vector propelling the wind driven vehicle forward attributable to the apparent wind (AW), acting on the sail, as compared to conventional sail configurations. The term "sail" may also be referred to as a "pliant sheet" to encompass the full scope and breadth of embodiments of the invention.

Now, referring primarily to FIG. 6A through FIG. 6C, inventive sail configurations or mast-sail configurations are in accord with general principals of fluid dynamics. The magnitude of the force (f) of air acting over a section of a sail equals the pressure (p) times the area (A) of the section of the sail or mast-sail combination.

$$p*A=(\text{force/area})*\text{area}=\text{force}$$

Pressure is a scalar quantity related to the momentum of the molecules of the air. Since force is a vector quantity, having both magnitude and direction, we must determine the direction of the pressure force on the sail or mast-sail configuration. Pressure acts perpendicular (or normal (n)) to the solid surfaces of the sail. The normal direction of the pressure changes based on the configuration of the opposite facing surfaces of the sail. The variation in pressure normal to the surface of the sail is shown by arrows (n) pointed perpendicular to the surface of the sail and mast. To obtain the net mechanical force (F) over the entire sail, the contributions of pressure on all the small sections of the sail must be summed. The net mechanical force (F) on the wind driven vehicle is equal to the sum of the product of the pressure (p) times the incremental change in area (ΔA) in the normal direction n.

$$F=\Sigma p*n*\Delta A$$

In the limit of infinitely small sections of the sail, this results in the integral of the pressure times the area (A) around the closed surface of the sail and mast.

$$F=\oint(p*n)\Delta A$$

If the pressure on the sail and mast is constant over the entire surface of both sides of the sail and mast, there is no net mechanical force (F) because the summation of the normal pressure on the sail surfaces and the mast surfaces add up to zero.

Accordingly, a broad object of particular embodiments of the invention can be to provide inventive mast configurations, sail configurations or mast-sail configurations and methods of configuring a mast, a sail or a mast-sail combination, that by comparison to conventional mast, sail, and mast-sail configurations, increase the magnitude of pressure on the sail backward facing side and concurrently decrease the magnitude of pressure on the sail forward facing side to increase the differential pressure to push the wind driven vehicle forward with greater thrust for a given sail area.

The inventive mast configurations, sail configurations or mast-sail configurations can be achieved by a mast or a mast sleeve having a pliant sheet coupler capable of orientation in front of the mast with a pliant sheet coupled to the pliant sheet coupler and extending from the pliant sheet coupler oriented at front of the mast over either a mast first side or a mast second side to a connection behind the mast. The mast or the mast sleeve can be adapted to rotate about the mast longitudinal axis (MLA) in either direction from a first configuration having the pliant sheet oriented in front of the mast and extending over the mast first side to a second configuration having the pliant sheet oriented in front of the mast and extending over the mast second side, such that that the wind driven vehicle can operate appropriately in either configuration relative to the true wind versus the boat direction.

The practical equation for Bernoulli's principle is to solve for the lift force (L) of a given airfoil design. This can be solved using the following equation:

$$L=\frac{1}{2}C_L\rho V^2A$$

The coefficient of lift ($C_L$) is usually experimentally derived but estimates of the coefficient of lift ($C_L$) can be obtained for different sail configurations or mast-sail configurations. The density of air (p) at sea level is typically around 1.225 kg/m$^2$. The velocity (V) can vary greatly but as long as the same value for different sail or mast-sail configurations is used, a valid comparison can be obtained between the two sail configurations or mast-sail configurations. The area (A) of the sail can also vary greatly between different sail configurations or mast-sail configurations, but again for comparison, the same area can be maintained for different sail configurations or mast-sail configurations. Therefore, the majority of the comparison can be resolved around the changes in the coefficient of lift ($C_L$).

A flat board alone at a favorable angle of attack to the oncoming airflow can have a coefficient of lift ($C_L$) of as high as 0.5. An airfoil of 2% thickness to length ratio also has a maximum coefficient of lift ($C_L$) of 0.5. Therefore, it can be concluded that a conventional sail has a maximum coefficient of lift ($C_L$) of 0.5 as well. By comparison, a wing at a poor angle of attack to the oncoming airflow (AF) can have a coefficient of lift ($C_L$) of 0.5 also. An airfoil of 12% thickness to length ratio at a more favorable angle of attack to the oncoming airflow (AF) can have a coefficient of lift as high as 1.7. This difference between a conventional flat sail and embodiments of the inventive sail configuration or mast-sail configuration can afford over three times more lift for the same surface area. Particular embodiments of the invention allow the sail to be rotated into sail configurations or mast-sail configurations, that by comparison to conventional sail configurations, significantly increase the magnitude of coefficient of lift ($C_L$), and therefore, increase the net mechanical force (F) of the sail on the wind driven vehicle.

With respect to airflow (AF) moving over the inventive sail attributable to the forward movement (FM) of a wind driven vehicle, the airflow velocity can have different values at different locations on the sail. Pressure on the sail relates to the airflow velocity on each small section of the sail. The pressure varies at each small section of the sail depending on the airflow velocity on each small section of the sail. Summing the pressures perpendicular to the surface of the sail times the area of the sail produces net mechanical force (F). Bernoulli's principle states that an increase in the speed of a fluid occurs simultaneously with a decrease in static pressure or a decrease in the fluid's potential energy. If a first airflow (AF1) passes a sail first surface of the sail at a first airflow velocity (V1) and a second airflow (AF2) passes a sail second surface of the sail at a second airflow velocity (V2) slower than the first airflow velocity (V1), then Bernoulli's principle implies that the pressure on the sail first surface of the sail will be lower than on the sail second surface of the sail. This pressure difference can result in a net mechanical force (F) on the wind driven vehicle in the direction of the center of lift (COL) having a vector direction toward the sail second side surface of the sail as shown in the illustrative examples of FIGS. 6A through 6C.

Accordingly, another broad object of embodiments of the invention can be to provide inventive sail or mast-sail configurations and methods of configuring a sail or a mast-sail in which the pliant sheet coupled in front of the mast and extending over either a mast first side or a mast second side to a connection behind the mast can achieve an increase in velocity in the first air flow (AF1) around the forward facing side of the pliant sheet and a decrease in velocity in the second air flow (AF2) around the backward facing side of the pliant sheet which can correspondingly increase the pressure on the backward facing side of the pliant sheet and decrease the pressure on the forward facing side of the pliant sheet. In particular embodiments, the pliant sheet coupled to the pliant sheet coupler oriented toward the windward side of the wind driven vehicle, approximately straight toward the apparent wind (AW), can form a pressure pocket in between the mast or the mast sleeve and the pliant sheet which can move the force vector of the center of lift (COL) further toward the front of the wind driven vehicle.

Aircraft wing configurations having greater wing thickness to length ratios generate more lift at slower wind speeds than wing configurations having lesser wing thickness to length ratios. The wing thickness varies in part based on the operating speed of the aircraft. A supersonic aircraft has a wing thickness that can be comparatively thin. The thickness of a jet aircraft wing can be comparatively thicker and when the wing flaps are down for take-off and landing the wing thickness can be even thicker. The thickness of a glider wing is thicker still. Even though a sail and mast have a vertical orientation, rotation of the mast or the mast sleeve to vary the sail thickness (ST) of embodiments of the invention can be similar to the use of wing flaps on an airplane. There can be a substantial advantage in inventive sail configurations in which the sail thickness (ST) can be varied to accommodate different wind speeds, different sailboat speeds, and different angles of the apparent wind (AW).

Accordingly, a broad object of particular embodiments of the invention can be to provide inventive sail configurations and mast-sail configurations and methods of configuring a sail and mast-sail to vary the sail thickness (ST) to sail length (SL) to create sail thickness to sail length ratios that significantly increase the magnitude of the coefficient of lift ($C_L$). As shown in the illustrative examples of 4E-4H, 6B-6C, embodiments can include a mast or a mast sleeve having an elongate transverse cross section through the mast longitudinal axis (MLA), wherein the mast or the mast sleeve has a mast sleeve length greater than a mast sleeve width, and in particular embodiments the mast or the mast sleeve can have an ovate, lanceolate, or teardrop transverse cross section through the mast longitudinal axis (MLA) of the mast which can control the sail thickness (ST) of the sail depending upon whether the broad end of the mast or mast sleeve has an orientation toward the apparent wind (AW) to generate a greater sail thickness (ST), or the narrow end of the mast or mast sleeve has an orientation toward the apparent wind (AW) to generate a lesser sail thickness (ST), or has an orientations between the two conditions allowing variability in the sail thickness (ST). This affords the substantial advantage of allowing variability in the sail thickness (ST) to accommodate different wind speeds, different vehicle speeds, and different angles of the apparent wind (AW).

Another broad object of particular embodiments of the invention can be to provide inventive sail configurations and methods of configuring a sail that include airflow modifying elements distributed in part or in whole over the mast or the mast sleeve. Now, with primary reference to FIGS. 4A-4B 4D-4F, 5A-5D and 6C, embodiments can have airflow modifying elements distributed over a portion of the mast external surface, or over a mast sleeve external surface rotatable around the mast, which generated a turbulent boundary layer (TBL) of the airflow (AF) adjacent the mast external surface or the mast sleeve external surface. The turbulent boundary layer (TBL) can cause the airflow (AF) to remain associated over a greater portion of the mast external surface or the mast sleeve external surface as compared to a mast or a mast sleeve lacking the airflow modifying elements. The delay in airflow separation from the mast external surface or the mast sleeve external surface can result in a decrease in drag (D) or increase in the pressure on the sail backward facing side and can alter the direction and magnitude of the center of lift (COL), and combinations thereof.

Naturally, further objects of the invention are disclosed throughout other areas of the specification, drawings, photographs, and claims.

IV. BRIEF DESCRIPTION OF THE DRAWINGS

FIG. 1 is a side elevation view of a wind driven vehicle in the form of sailboat including a particular embodiment of the inventive forward propulsion system including one or more of a mast or a mast sleeve having a pliant sheet coupler capable of orientation at a mast front with a pliant sheet extending from the pliant sheet coupler over either a mast first side or a mast second side to a connection behind the mast and a vector diagram showing true wind (TW) and forward motion (FM) of the wind driven vehicle and generation of the apparent wind (AW) which can act on the pliant sheet or mast-pliant sheet configuration.

Figure 2:
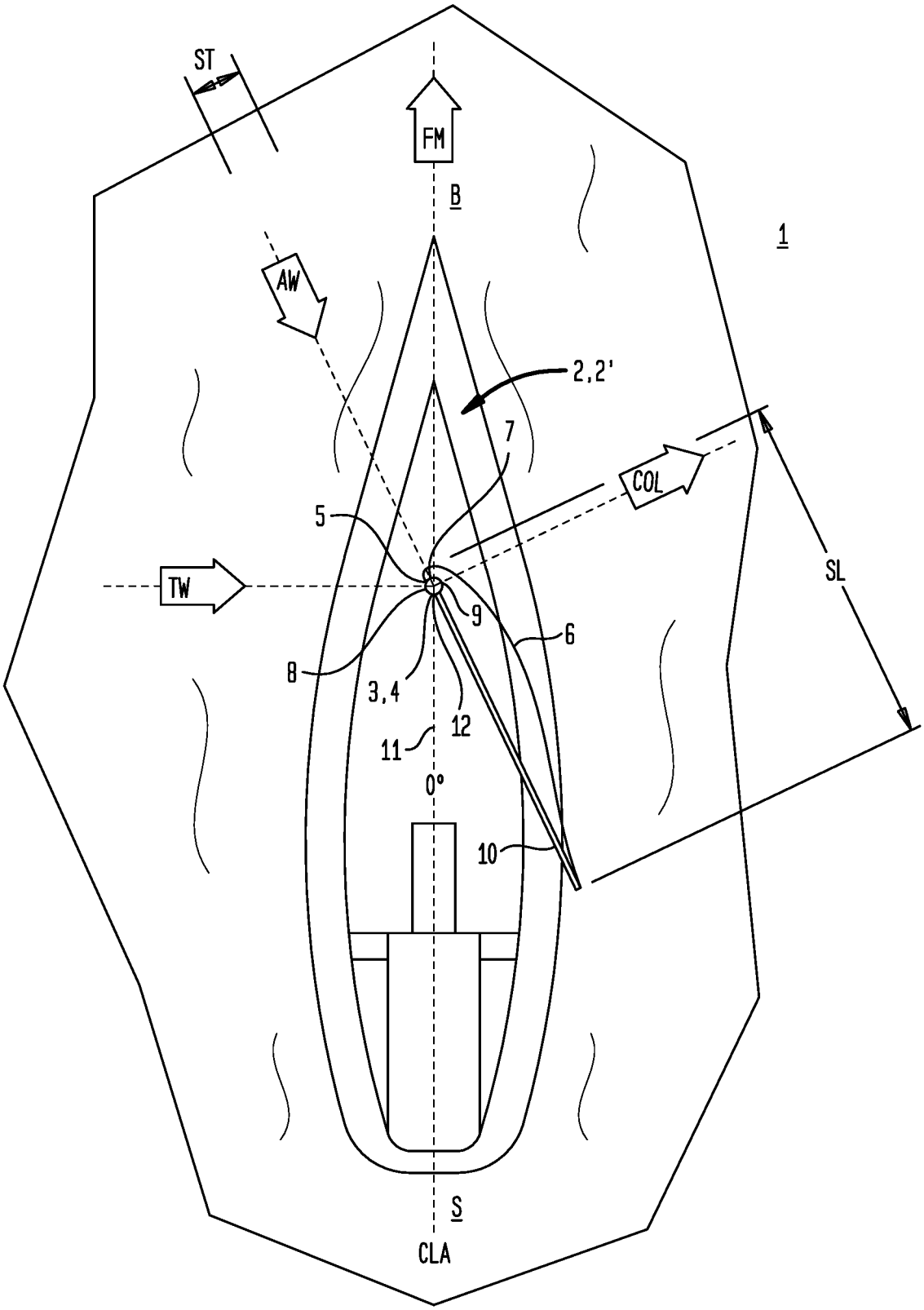
FIG. 2 is a top plan view of the wind driven vehicle including the particular embodiment of the inventive sail as shown in FIG. 1 including the vector diagram showing true wind (TW) and forward motion (FM) of the wind driven vehicle and generation of the apparent wind (AW) which can contribute to the center lift (COL) acting on the sail.
Figure 3:
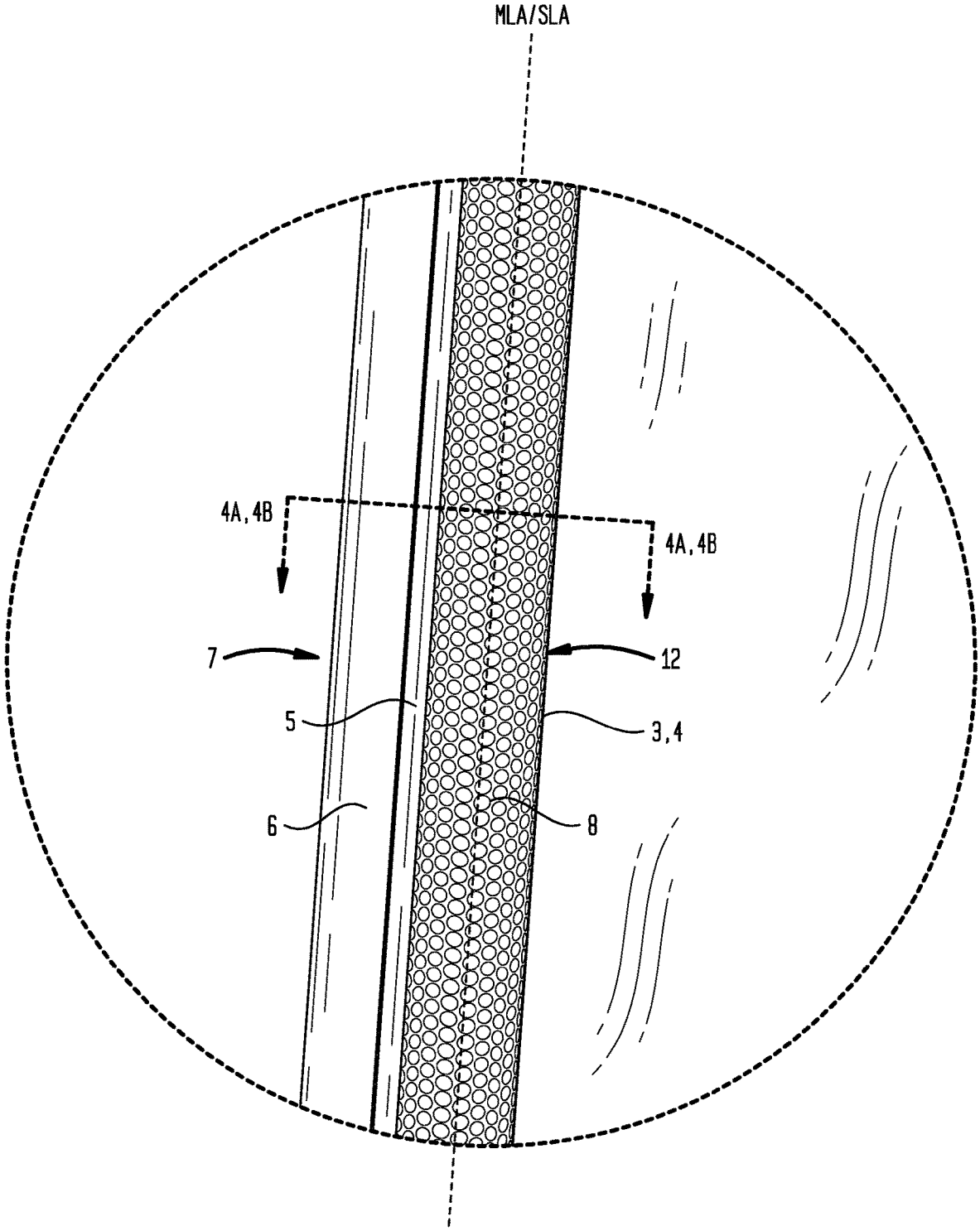
FIG. 3 is an enlargement of a portion of FIG. 1 illustrating a particular embodiment of airflow modifying elements disposed on the mast or the mast sleeve external surface to generate a turbulent boundary layer (TBL) in the airflow adjacent the mast or the mast sleeve external surface.
Figure 4A:
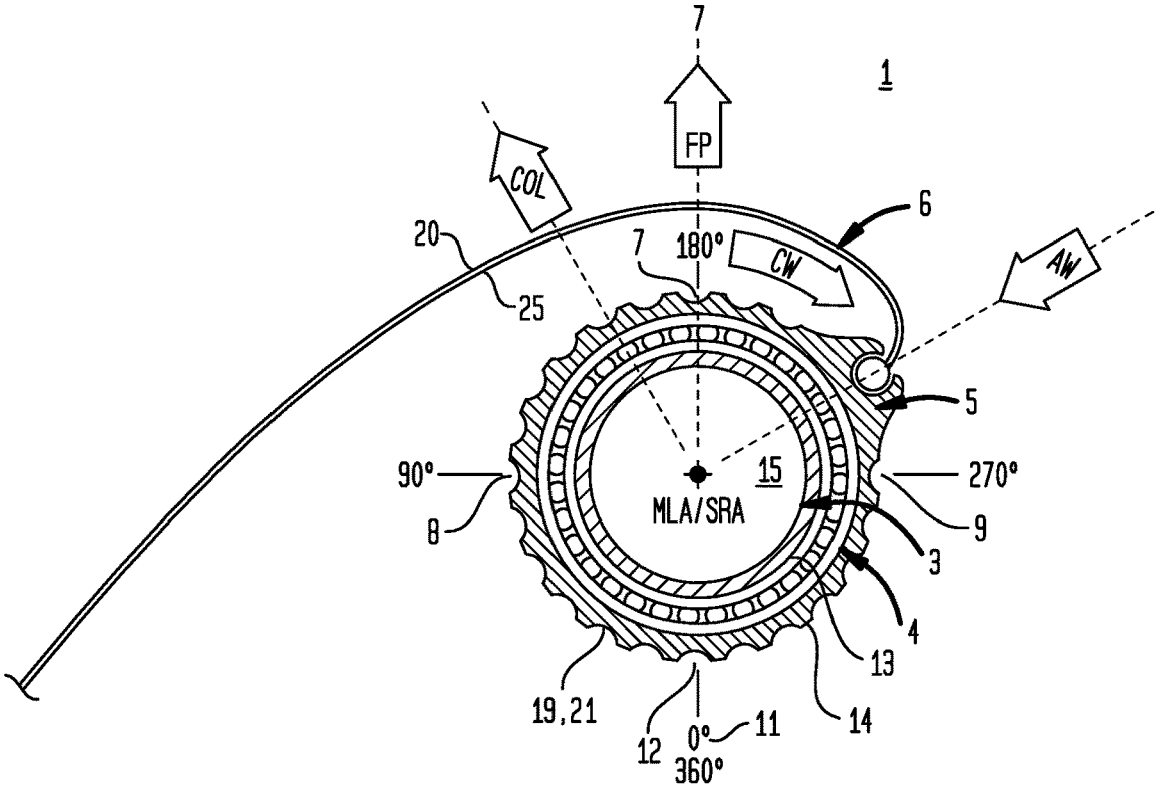

FIG. 4A is cross section 4A-4A shown in FIG. 3 illustrating a particular embodiment of a mast sleeve having a pliant sheet coupler rotatable in clockwise direction around a mast longitudinal axis (MLA) in the range of about 90 degrees to about 270 degrees in relation to a zero-degree position of the pliant sheet coupler aligned with the central longitudinal axis (CLA) facing the stern of sailboat illustrated in FIG. 2.

Figure 4B:
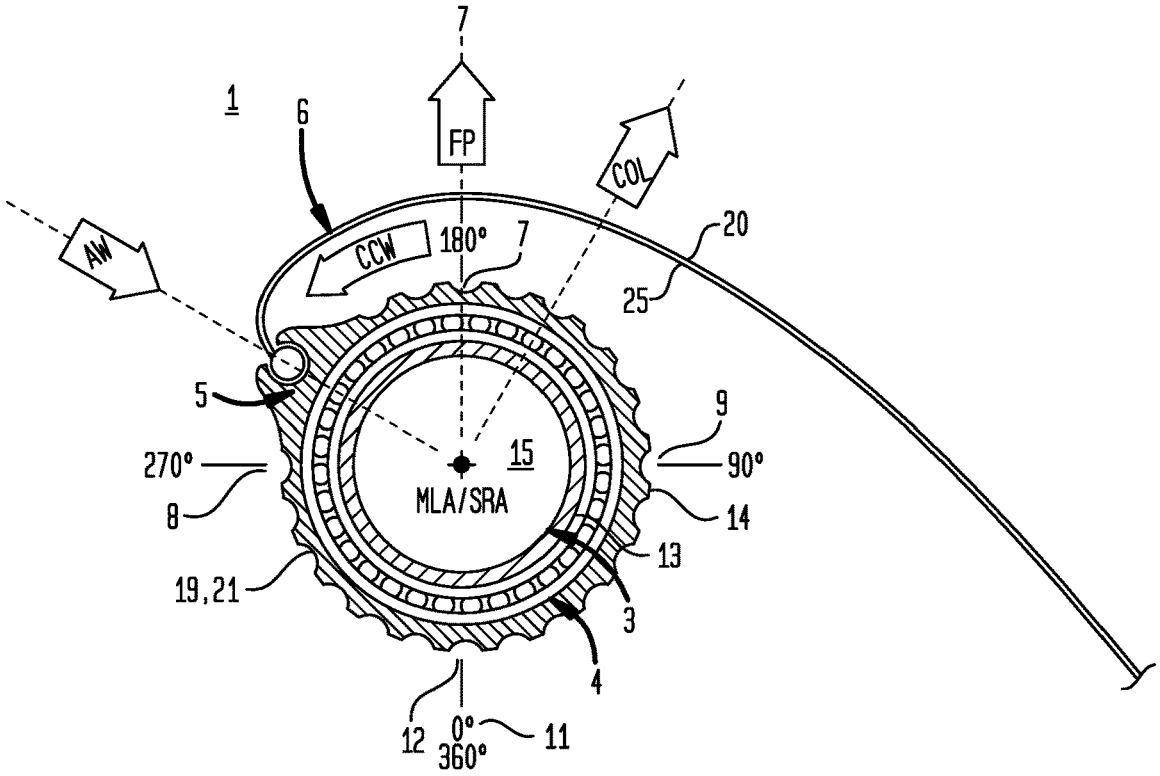

FIG. 4B is cross section 4B-4B shown in FIG. 3 illustrating a particular embodiment of a mast sleeve having a pliant sheet coupler rotatable in counterclockwise direction around a mast longitudinal axis (MLA) in the range of about 90 degrees to about 270 degrees in relation to a zero-degree position of the pliant sheet coupler aligned with the central longitudinal axis (CLA) and facing the stern (S) of sailboat illustrated in FIG. 2.

Figure 4D:
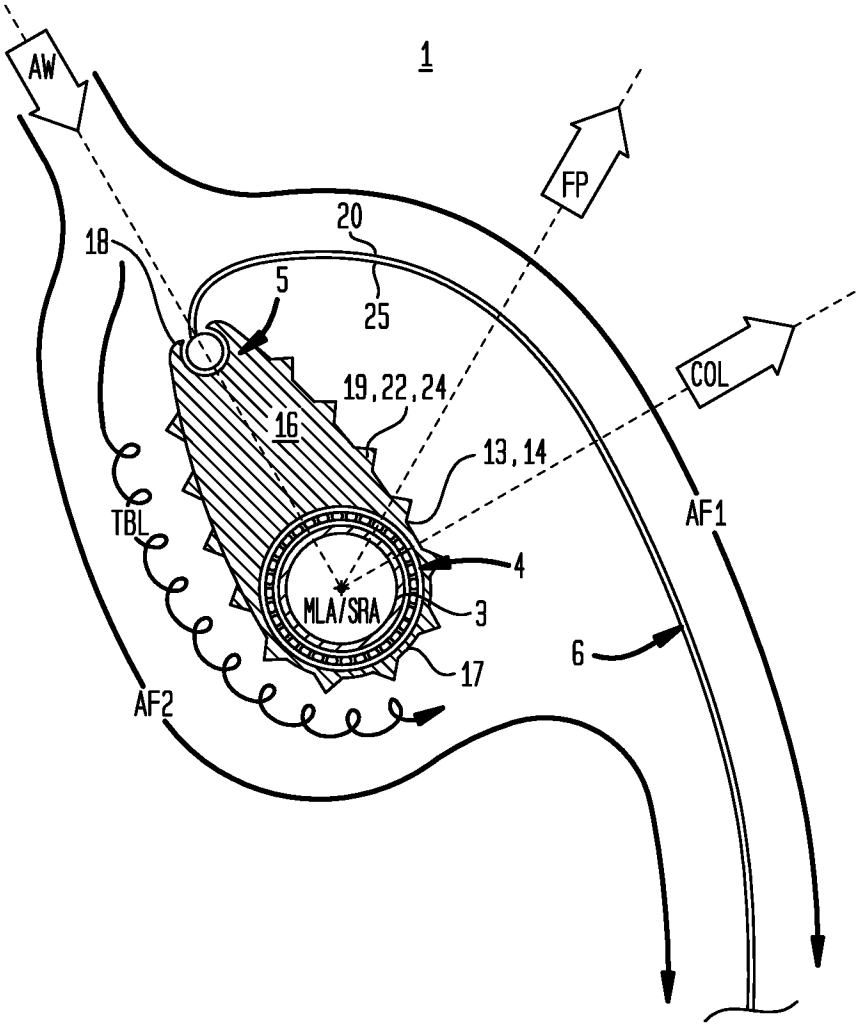
Figure 4C:
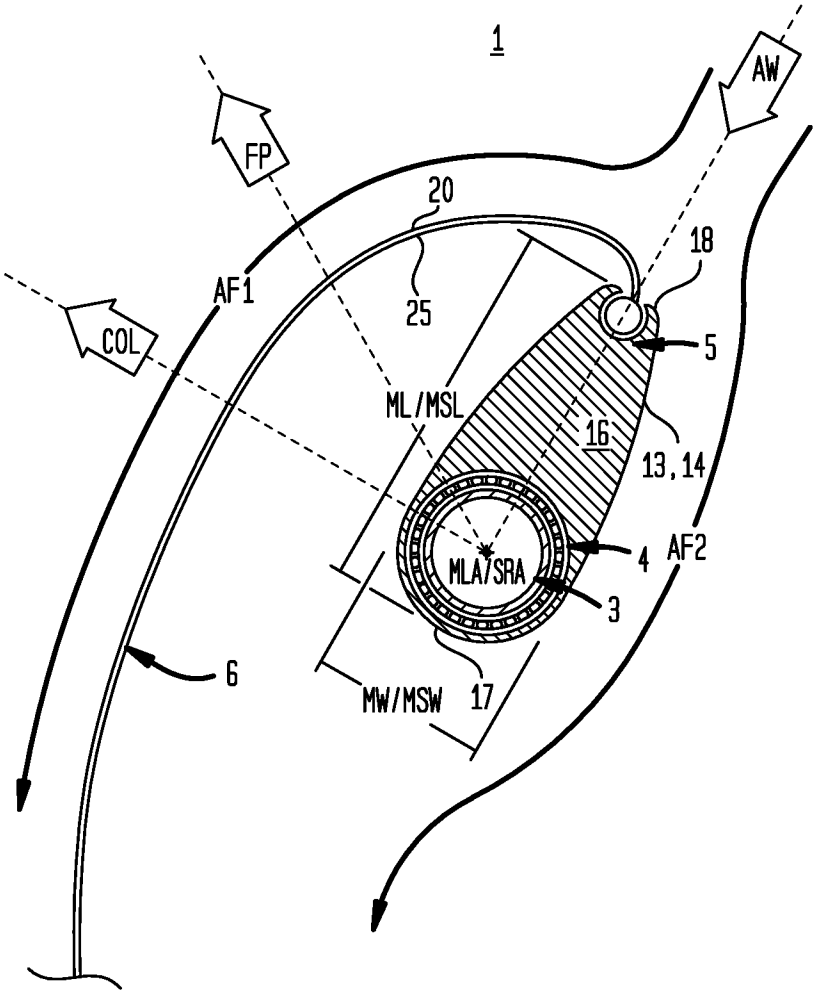

FIG. 4C is a cross section transverse to a mast longitudinal axis illustrating a first airflow (AF1) and a second airflow (AF2) moving over a particular embodiment of a mast sleeve having a pliant sheet coupler rotatable in clockwise or counterclockwise direction around the mast longitudinal axis (MLA) toward or to the direction of the apparent wind (AW) to correspondingly move the center of lift (COL) toward the bow (B) of the sailboat to increase forward propulsion (FP).

FIG. 4D is a cross section transverse to a mast longitudinal axis illustrating a first airflow (AF1) and a second airflow (AF2) moving over a particular embodiment of a mast sleeve having a pliant sheet coupler rotatable in clockwise or counterclockwise direction around the mast longitudinal axis (MLA) toward or to the direction of the apparent wind (AW), wherein airflow modifying elements distributed over the mast sleeve external surface generate a turbulent boundary layer (TBL) adjacent the mast sleeve external surface opposite the pliant sheet facing side of the mast sleeve delaying separation of the second airflow (AF2) from the mast sleeve which decreases airflow velocity of the second airflow (AF2) and increases pressure on the pliant sheet backward facing side, whereby an increased pressure differential between the pliant sheet forward facing side and the pliant sheet backward facing side increases forward propulsion (FP).

Figure 4F:
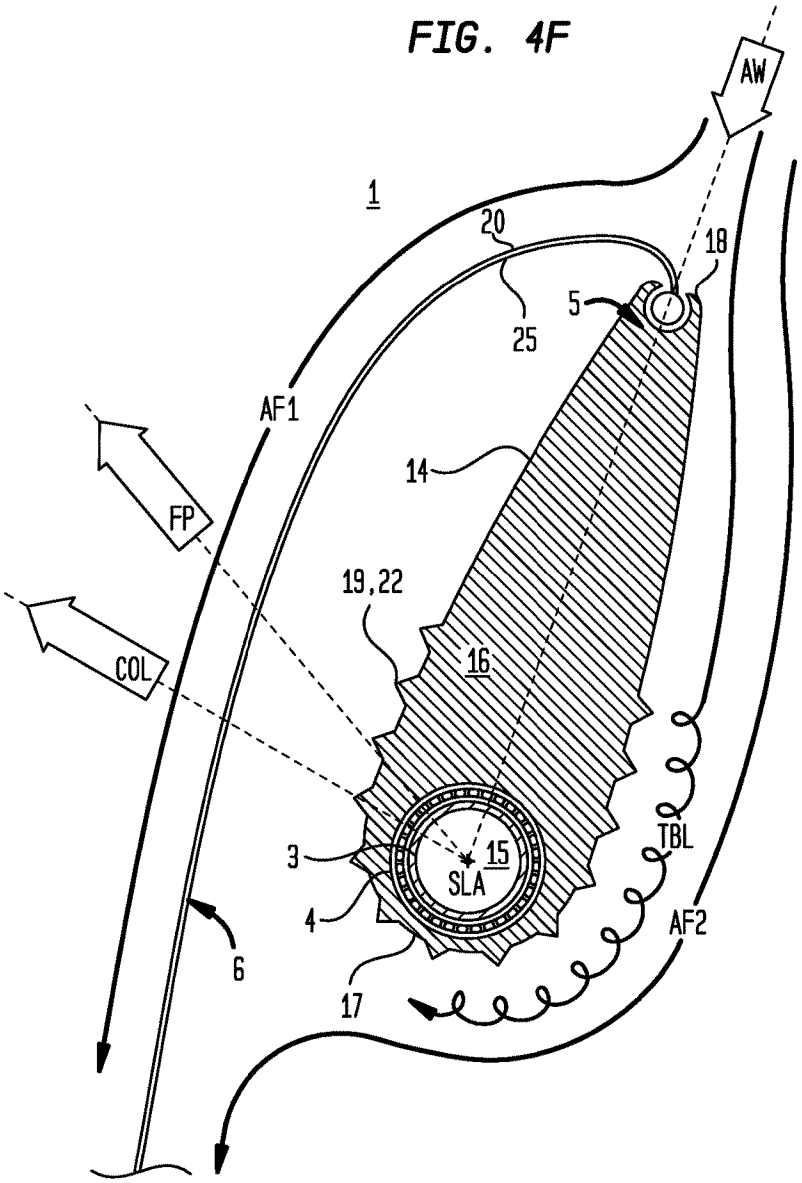
Figure 4E:
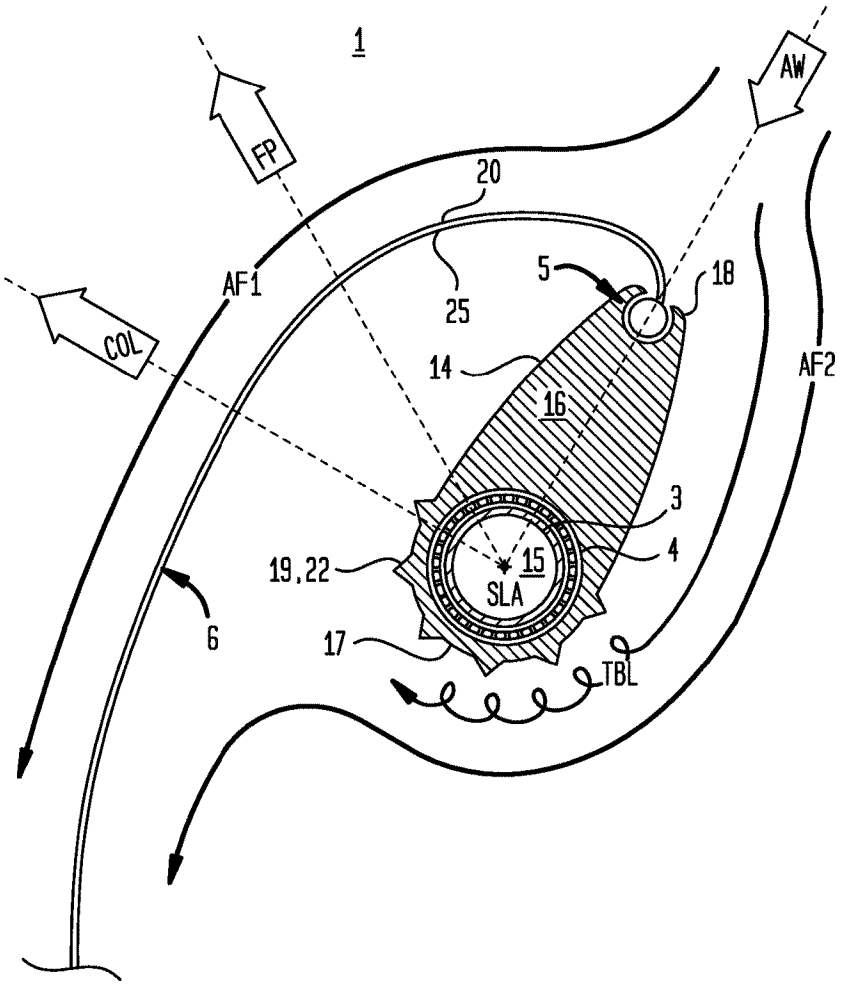

FIG. 4E is a cross section transverse to a mast longitudinal axis illustrating a first airflow (AF1) and a second airflow (AF2) moving over a particular embodiment of a mast sleeve having a pliant sheet coupler rotatable in clockwise or counterclockwise direction around the mast longitudinal axis (MLA) toward or to the direction of the apparent wind (AW), wherein airflow modifying elements disposed on the broad end of the elongate mast sleeve generate a turbulent boundary layer (TBL) adjacent the mast sleeve external surface opposite the pliant sheet facing side of the mast sleeve delaying separation of the second airflow (AF2) from the mast sleeve which decreases airflow velocity of the second airflow (AF2) and increases pressure on the pliant sheet backward facing side, whereby an increased pressure differential between the inward facing sail surface and the outward facing sail surface increases forward propulsion (FP).

FIG. 4F is a cross section transverse to a mast longitudinal axis illustrating a first airflow (AF1) and a second airflow (AF2) moving over a particular embodiment of a mast sleeve having a pliant sheet coupler rotatable in clockwise or counterclockwise direction around the mast longitudinal axis (MLA) toward or to the direction of the apparent wind (AW), wherein the mast sleeve has a greater sleeve length (SL) as compared to the elongate sleeve shown in FIG. 4E which disposes the pliant sheet coupler further toward the windward side of the sailboat and moves the center of lift (COL) toward the bow of the sailboat which by comparison to the embodiment of 4E increases the forward propulsion (FP), and wherein airflow modifying elements disposed on the broad end of the elongate mast sleeve generate a turbulent boundary layer (TBL) adjacent the mast sleeve external surface opposite the pliant sheet facing side of the mast sleeve delaying separation of the second airflow (AF2) from the mast sleeve which decreases airflow velocity of the second airflow (AF2) and increases pressure on the pliant sheet backward facing side, whereby an increased pressure differential between the inward facing sail surface and the outward facing sail surface further increases forward propulsion (FP).

Figure 4H:
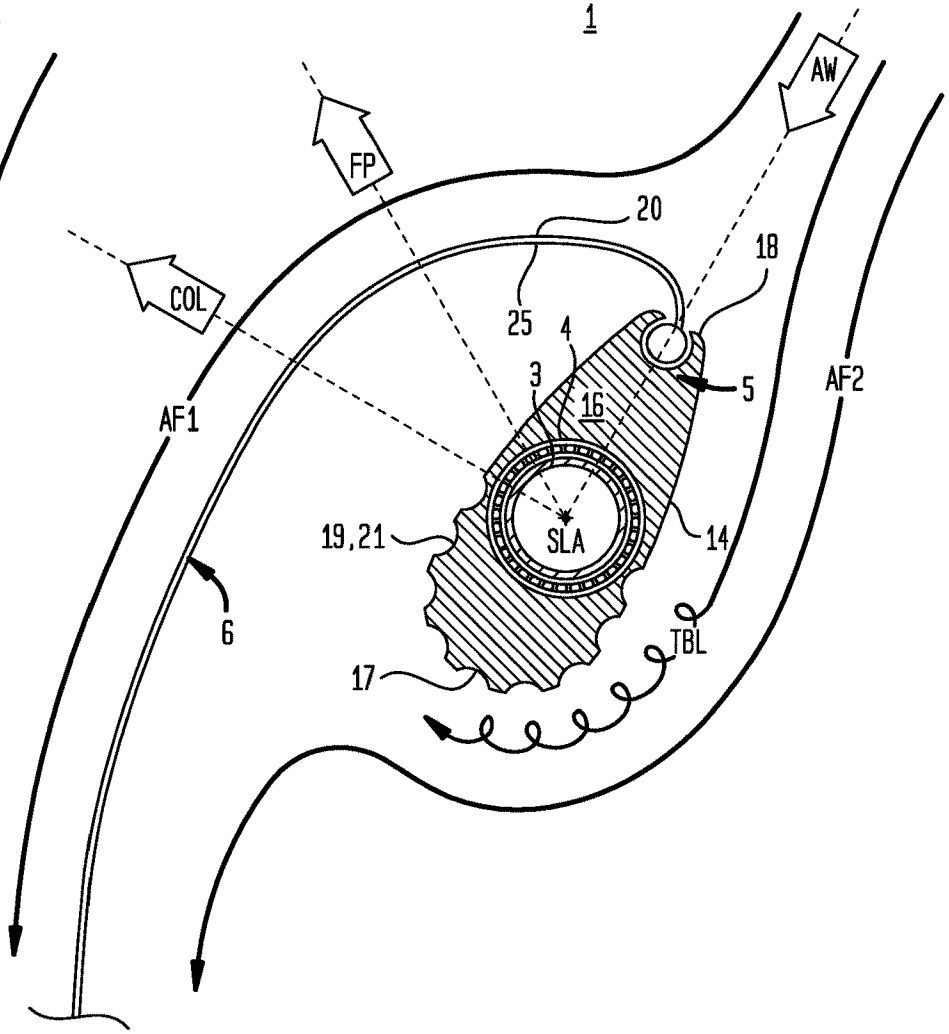
Figure 4G:
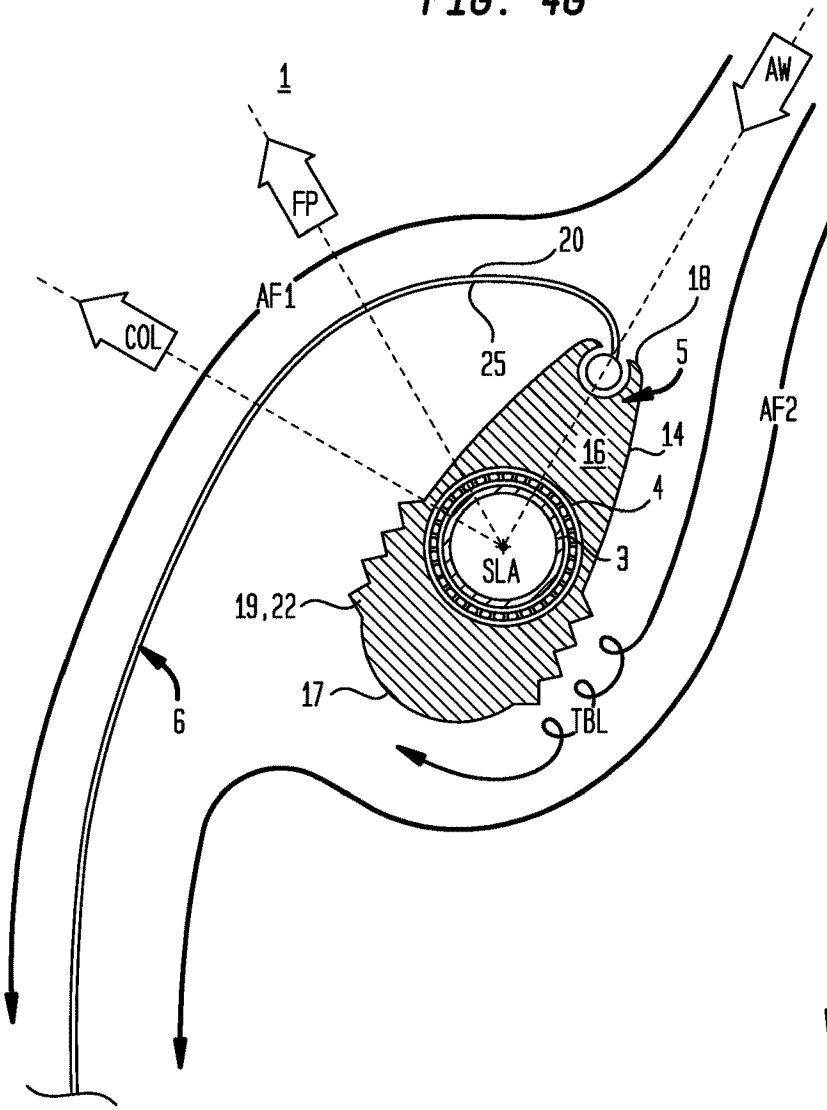

FIG. 4G is a cross section transverse to a mast longitudinal axis illustrating a first airflow (AF1) and a second airflow (AF2) moving over a particular embodiment of a mast sleeve having a pliant sheet coupler rotatable in clockwise or counterclockwise direction around the mast longitudinal axis (MLA) toward or to the direction of the apparent wind (AW), wherein the mast longitudinal axis (MLA) has a position medially between a broad end and a narrow end of the elongate mast sleeve, wherein airflow modifying elements disposed on the opposed medial sides of the elongate mast sleeve generate a turbulent boundary layer (TBL) adjacent the mast sleeve external surface opposite the plaint sheet facing side of the mast sleeve delaying separation of the second airflow (AF2) from the mast sleeve which decreases airflow velocity of the second airflow (AF2) and increases pressure on the pliant sheet backward facing side, whereby an increased pressure differential between the pliant sheet forward facing side and the pliant sheet backward facing side increases forward propulsion (FP).

FIG. 4H is a cross section transverse to a mast longitudinal axis illustrating a first airflow (AF1) and a second airflow (AF2) moving over a particular embodiment of a mast sleeve having a pliant sheet coupler rotatable in clockwise or counterclockwise direction around the mast longitudinal axis (MLA) toward or to the direction of the apparent wind (AW), wherein the mast longitudinal axis (MLA) has a position medially between a broad end and a narrow end of the elongate mast sleeve, wherein the airflow modifying elements disposed on the opposed medial sides and broad end of the elongate mast sleeve generate a turbulent boundary layer (TBL) adjacent the mast sleeve external surface opposite the plaint sheet facing side of the mast sleeve delaying separation of the second airflow (AF2) from the mast sleeve which decreases airflow velocity of the second airflow (AF2) and increases pressure on the pliant sheet backward facing side, whereby an increased pressure differential between the pliant sheet backward facing side and the pliant sheet forward facing side increases forward propulsion (FP).

Figure 5A:
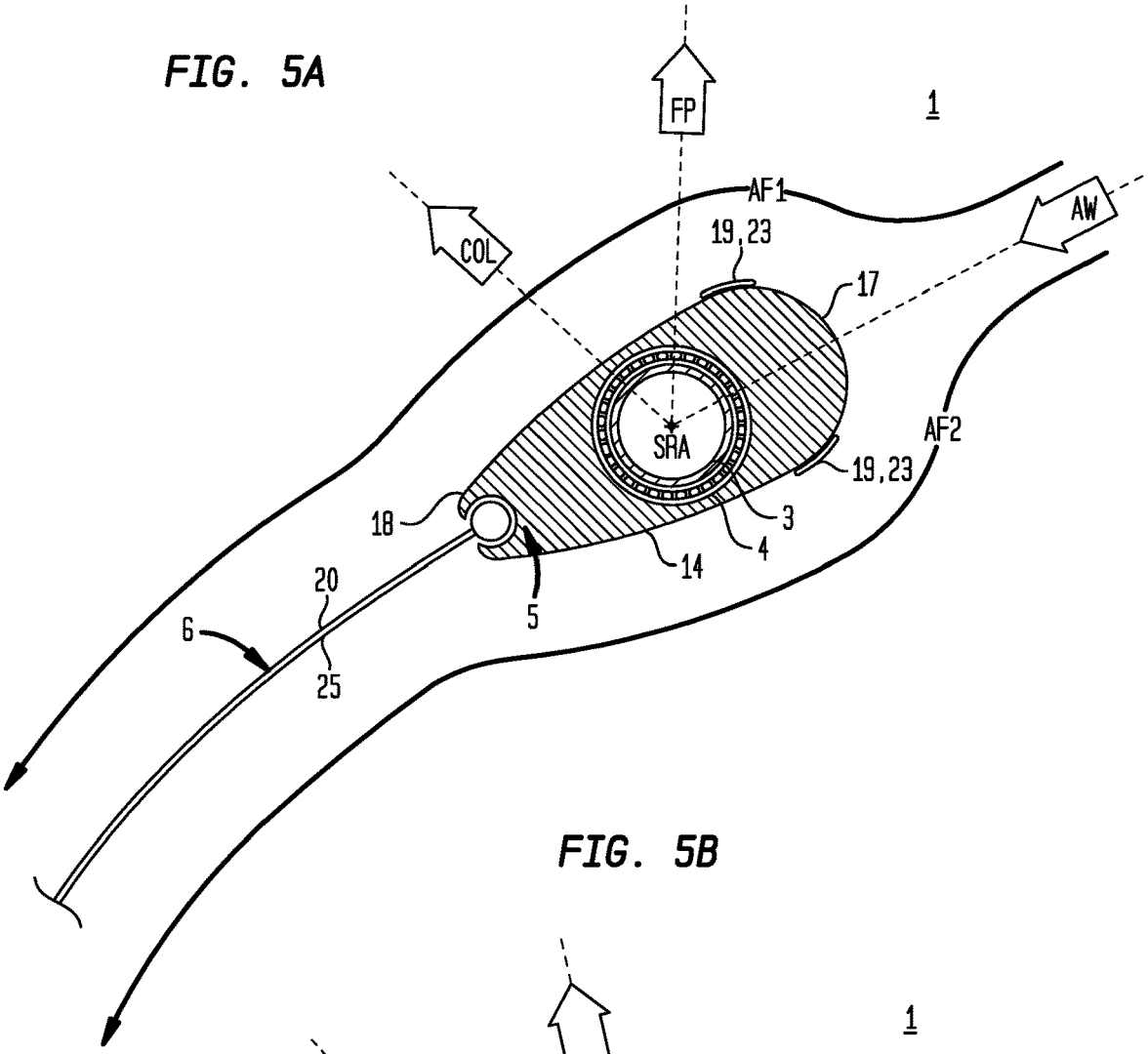

FIG. 5A is a cross section transverse to a mast longitudinal axis illustrating a first airflow (AF1) and a second airflow (AF2) moving over a particular embodiment of a mast sleeve having a pliant sheet coupler rotatable in clockwise or counterclockwise direction around the mast longitudinal axis (MLA) toward a first mast side or a second mast side of the wind driven vehicle, wherein the mast longitudinal axis (MLA) has a position medially between a broad end and a narrow end of the elongate mast sleeve, wherein another embodiment of the airflow modifying elements disposed on opposed medial sides of the elongate mast sleeve lie adjacent the mast sleeve external surface to maintain laminar flow of the first airflow (AF1) and the second airflow (AF2), wherein the elongate sleeve moves the center of lift (COL) toward the direction of the wind driven vehicle to increase forward propulsion (FP).

Figure 5B:
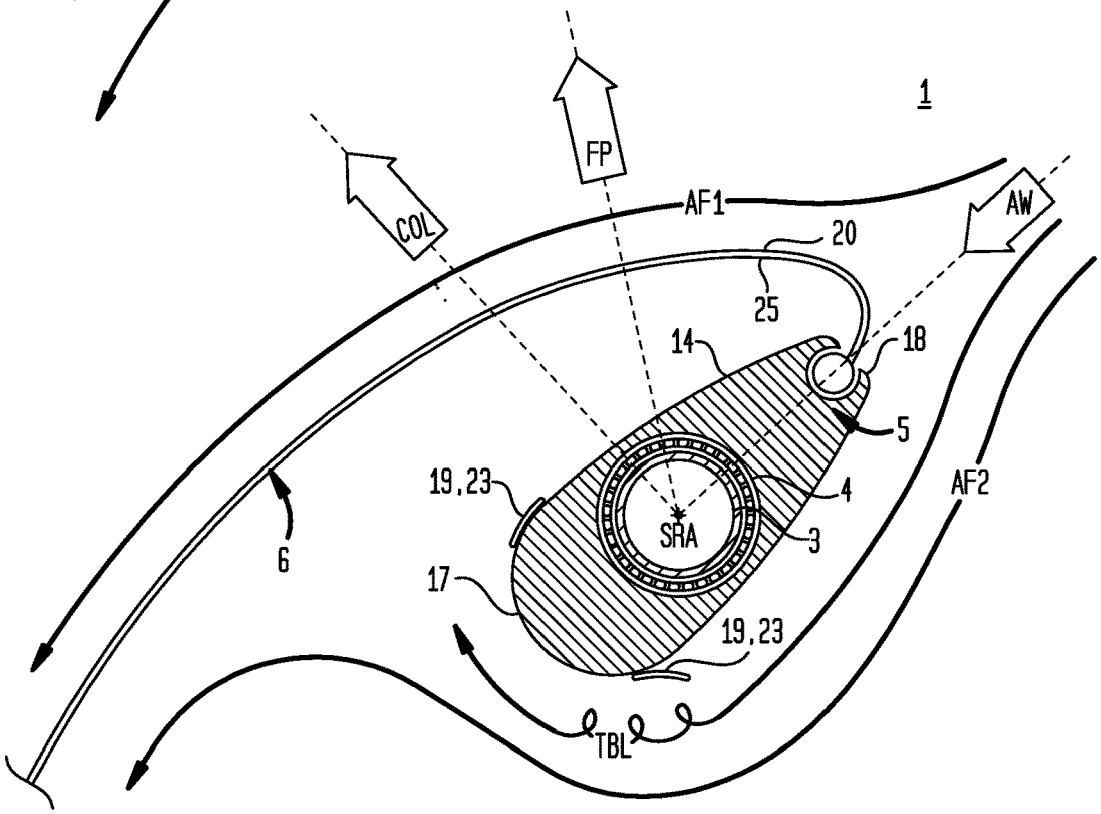

FIG. 5B is a cross section transverse to a mast longitudinal axis illustrating a first airflow (AF1) and a second airflow (AF2) moving over the embodiment of a mast sleeve shown in FIG. 5A having the pliant sheet coupler rotatable in clockwise or counterclockwise direction around the mast longitudinal axis (MLA) toward or to the direction of the apparent wind (AW), wherein the mast longitudinal axis (MLA) has a position medially between a broad end and a narrow end of the elongate mast sleeve, wherein the airflow modifying elements disposed opposite the pliant sheet facing side of the mast sleeve extend outward from the mast sleeve external surface to generate a turbulent boundary layer (TBL) adjacent the mast sleeve external surface opposite the sail facing side of mast sleeve delaying separation of the second airflow (AF2) from the mast sleeve which decreases airflow velocity of the second airflow (AF2) and increases pressure on the pliant sheet backward facing side, whereby an increased pressure differential between the pliant sheet backward facing side and the pliant sheet forward facing side increases forward propulsion (FP).

Figure 6A:
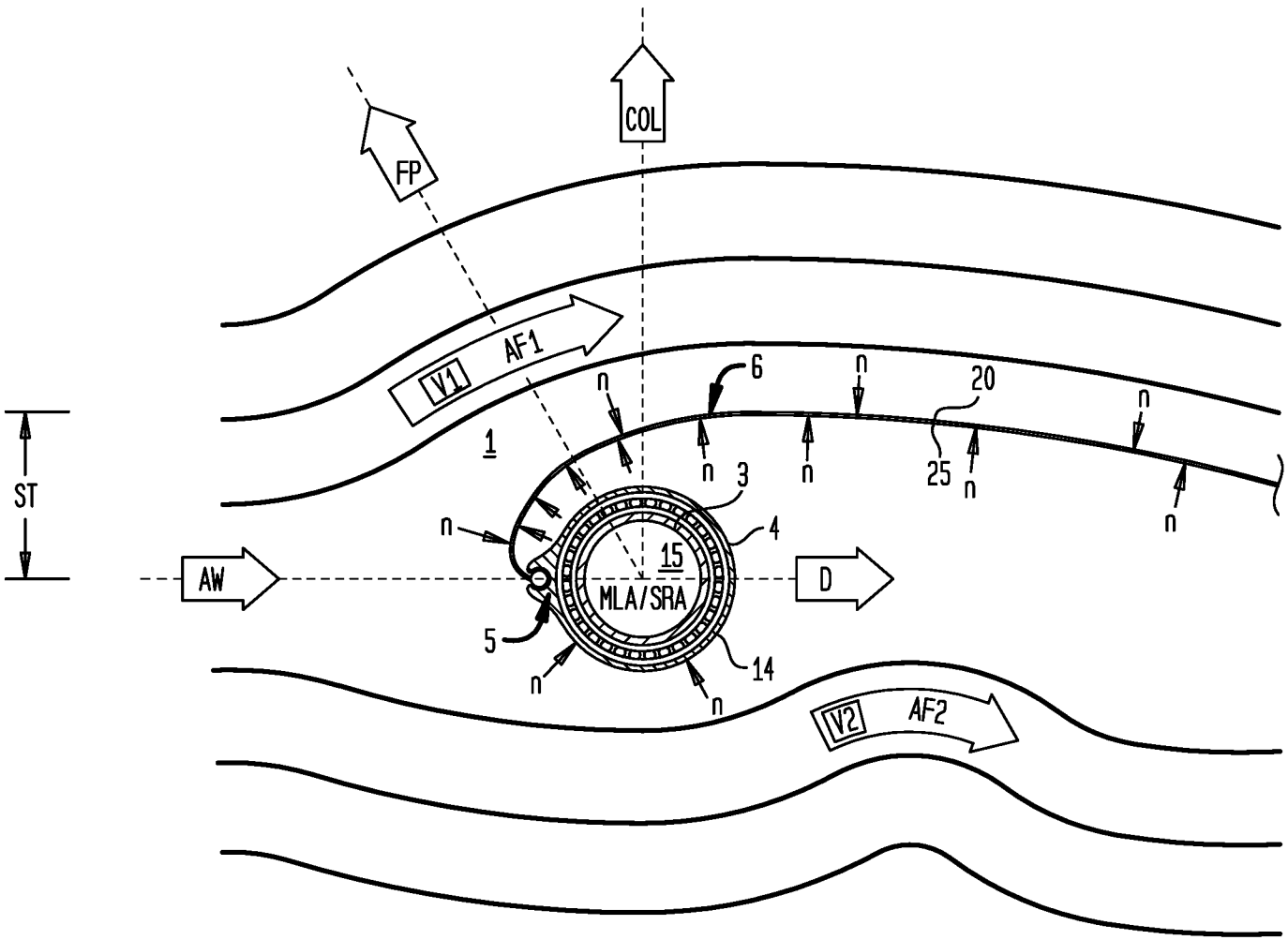

FIG. 6A is a cross section transverse to a mast longitudinal axis illustrating a first airflow (AF1) and a second airflow (AF2) moving over a circular mast sleeve having a pliant sheet coupler rotatable in clockwise or counterclockwise direction around the mast longitudinal axis (MLA) toward or to the direction of the apparent wind (AW), wherein rotation of the pliant sheet coupler toward or to the apparent wind (AW) around the circular mast sleeve increases the sail thickness (ST) to form a pliant sheet curvature extending from the pliant coupler to a pliant sheet connection behind the mast which increases the pressure differential between the pliant sheet forward facing side and the pliant sheet backward facing side there by increasing forward propulsion (FP).

Figure 6B:
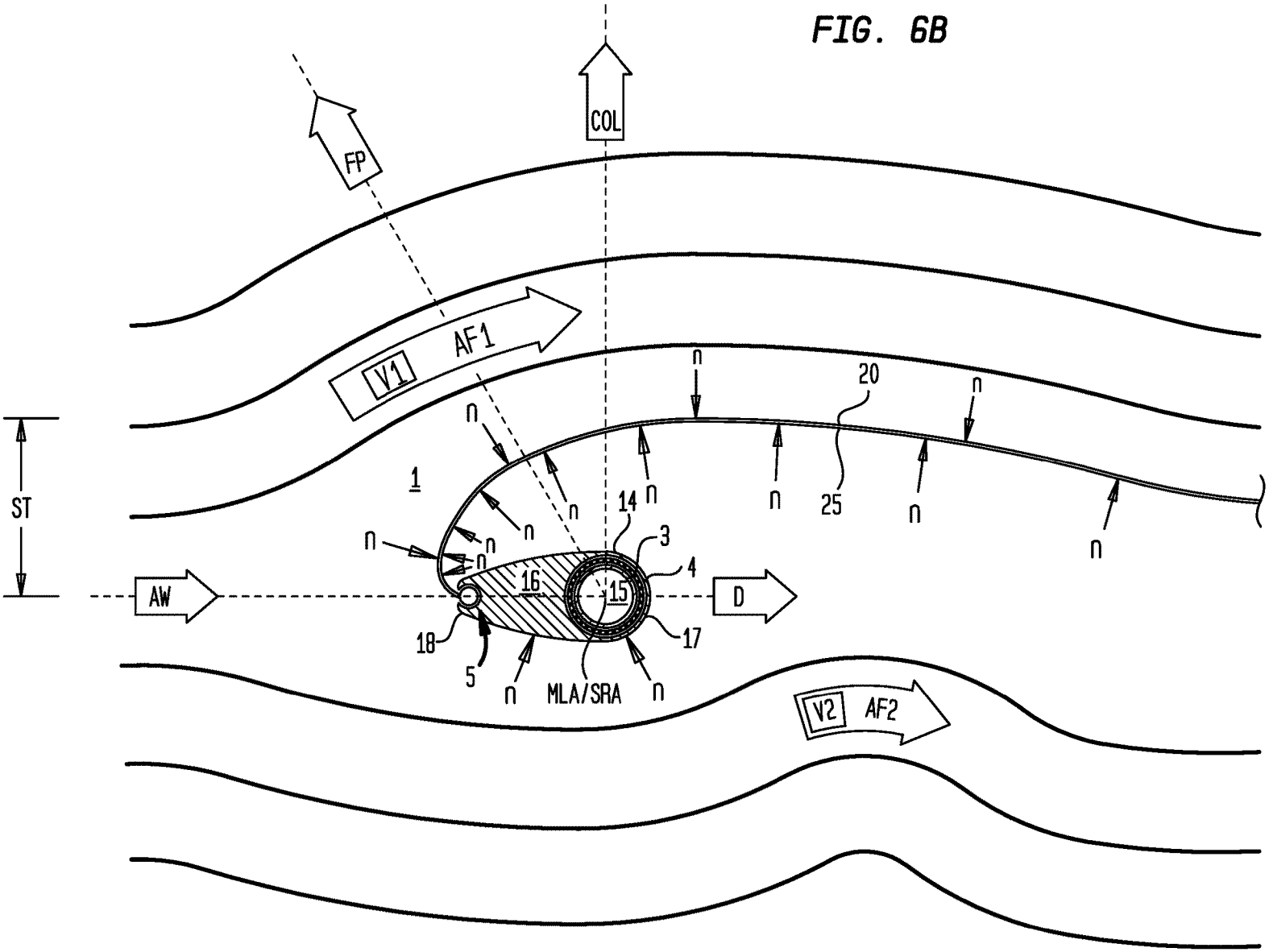

FIG. 6B is a cross section transverse to a mast longitudinal axis illustrating a first airflow (AF1) and a second airflow (AF2) moving over a elongate mast sleeve having the pliant sheet coupler rotatable in clockwise or counterclockwise direction around the mast longitudinal axis (MLA) toward or to the direction of the apparent wind (AW), wherein the elongate mast sleeve disposes the pliant sheet coupler further toward the windward side of the wind driven vehicle which moves the center of lift (COL) toward the bow of the wind driven vehicle to further increase the pressure differential between the pliant sheet forward facing side and the pliant sheet backward facing side thereby further increasing forward propulsion (FP) as compared to the embodiment shown in FIG. 6A.

Figure 6C:
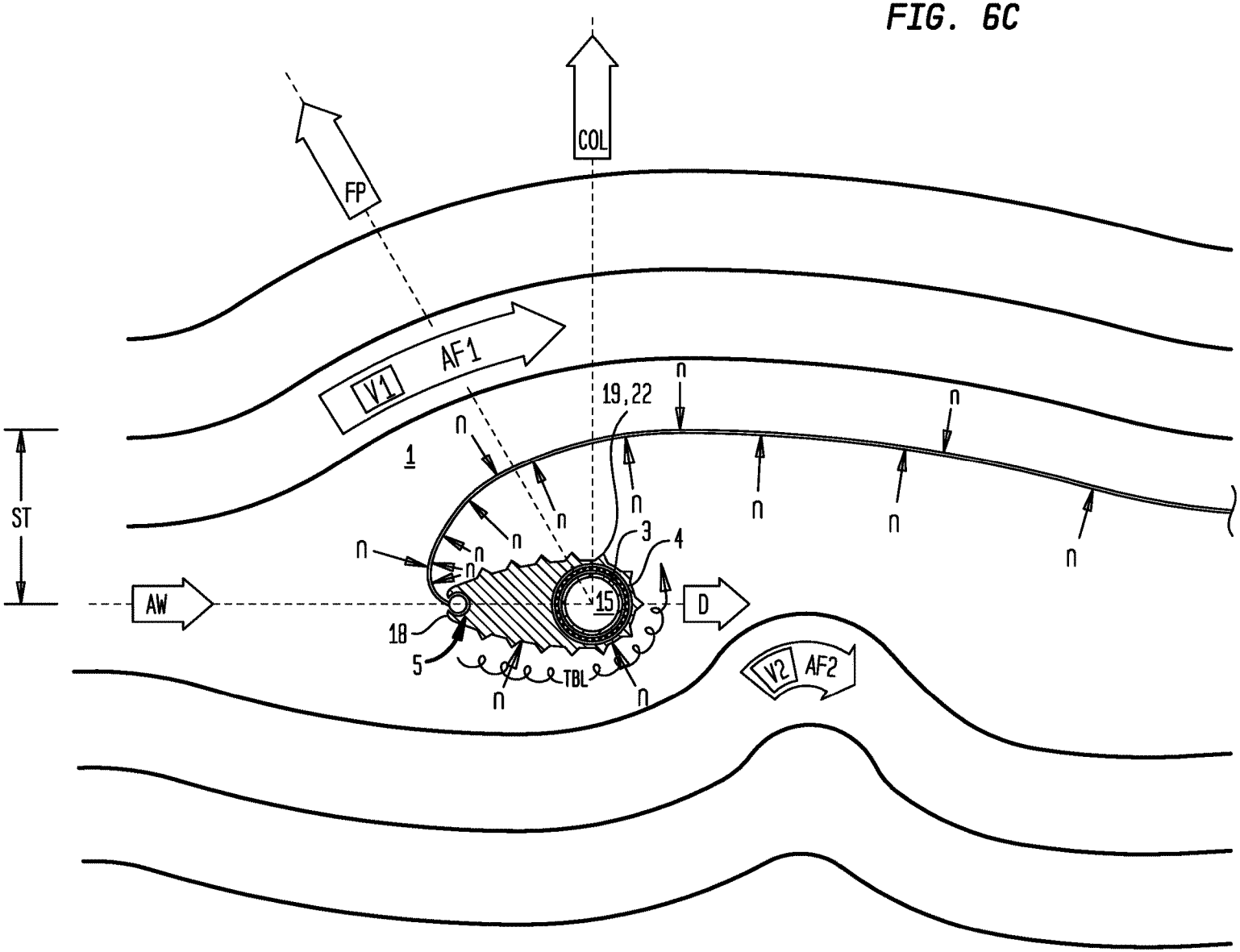

FIG. 6C is a cross section transverse to a mast longitudinal axis illustrating a first airflow (AF1) and a second airflow (AF2) moving over a elongate mast sleeve having the pliant sheet coupler rotatable in clockwise or counterclockwise direction around the mast longitudinal axis (MLA) toward or to the direction of the apparent wind (AW), wherein the elongate mast sleeve disposes the pliant sheet coupler further toward the windward side of the wind driven vehicle which moves the center of lift (COL) further toward the bow of the wind driven vehicle, and wherein airflow modifying elements disposed on the opposed medial sides and broad end of the elongate mast sleeve generate a turbulent boundary layer (TBL) adjacent the mast sleeve external surface opposite the pliant sheet facing side of the mast sleeve to delay separation of the second airflow (AF2) from the mast sleeve which decreases airflow velocity of the second airflow (AF2) to increase pressure on the pliant sheet backward facing side which further increases pressure differential between the pliant sheet forward facing side and the pliant sheet backward facing side, thereby further increasing forward propulsion (FP) as compared to the embodiment shown in FIG. 6B.

Figure 7B:
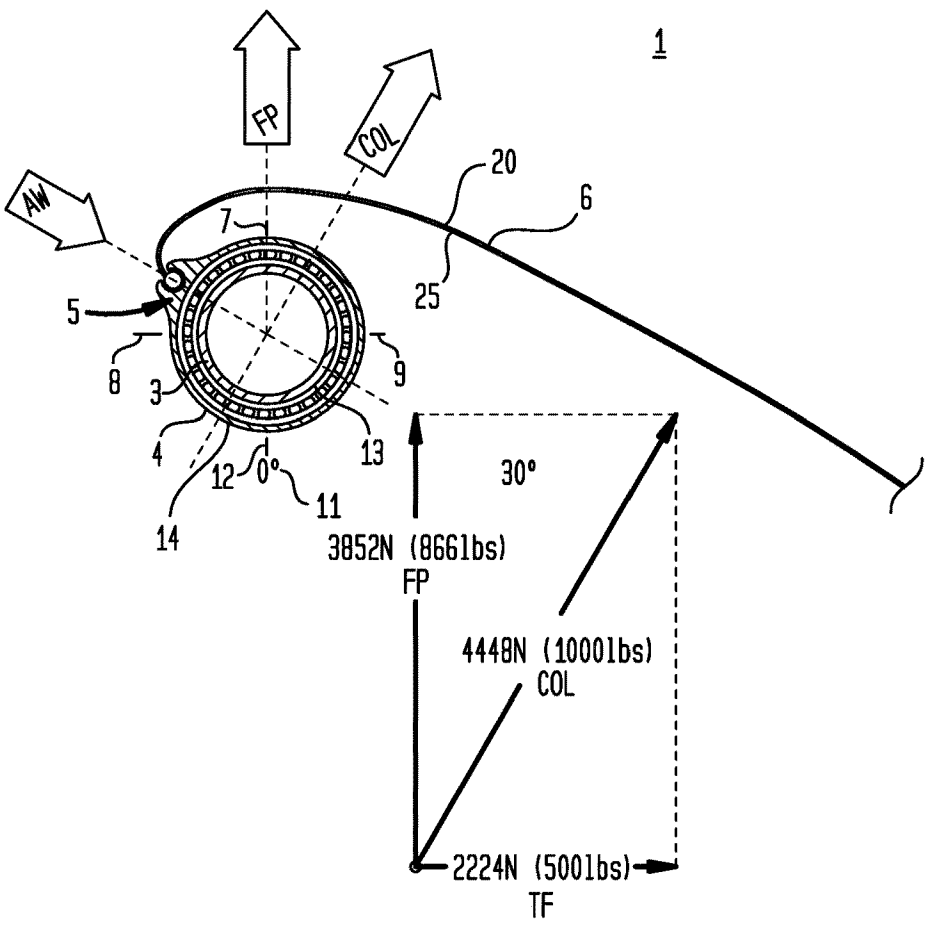
Figure 7A:
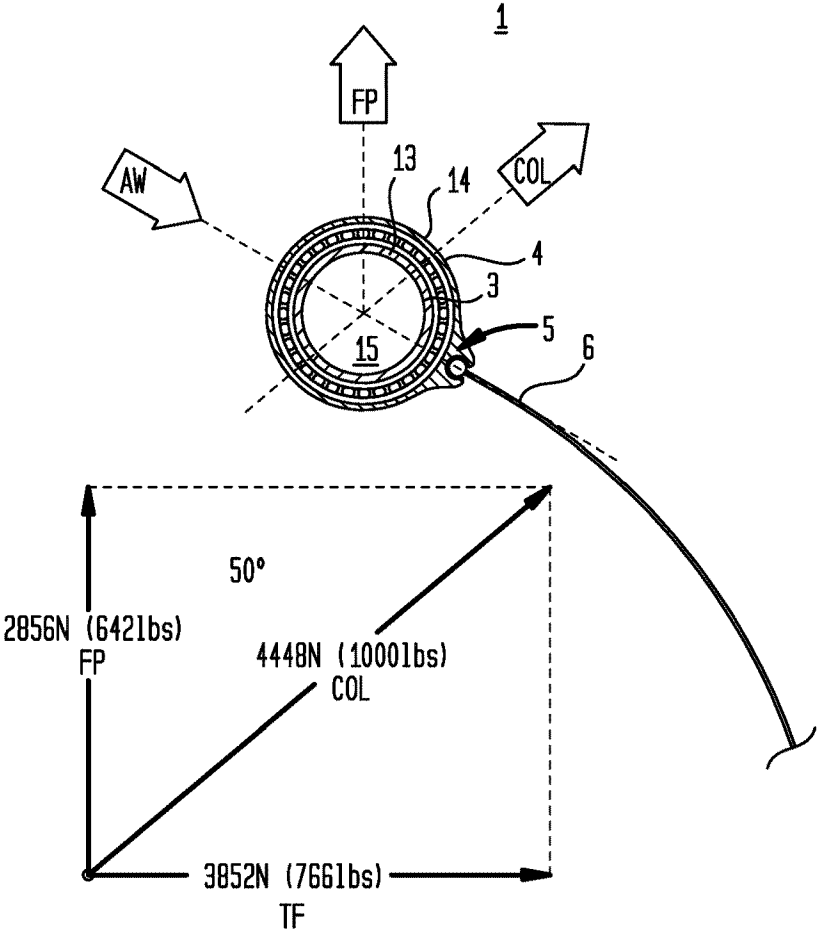

FIG. 7A is a cross section transverse to a mast longitudinal axis illustrating a mast sleeve having a pliant sheet coupler disposed at the mast back side with the pliant sheet extending from the pliant sheet coupler to a pliant sheet connection behind the mast, wherein the sail has an associated force of 4448 Newtons (1000 pounds) with a force vector at an angle of 50 degrees relative to the forward propulsion (FP) of the wind driven vehicle which develops 2856 Newtons (642 pounds) of force in the direction of the forward propulsion (FP) and a tipping force perpendicular to the direction of forward propulsion (FP) of 3852 Newtons (766 pounds) of force.

FIG. 7B is a cross section transverse to a mast longitudinal axis illustrating a mast sleeve having a pliant sheet coupler disposed at the mast front side toward or to the apparent wind (AW) and with the pliant sheet extending from the pliant sheet coupler to a pliant sheet connection behind the mast, wherein the sail has an associated force of 4448 Newtons (1000 pounds) with a force vector at an angle of 30 degrees relative to the forward propulsion (FP) of the wind driven vehicle which develops 3852 Newtons (866 pounds) of force in the direction of the forward propulsion (FP) with a tipping force perpendicular to the direction of forward propulsion (FP) of 2224 Newtons (500 pounds) of force.

V. DETAILED DESCRIPTION OF THE INVENTION

Generally, FIGS. 1, 2, 3, 4A-4H, 5A-5B, 6A-6C and 7A-7B, illustrate particular embodiments of an inventive an inventive forward propulsion system (1) and methods of making and using embodiments of the forward propulsion system (1) to propel a wind driven vehicle (2). While particular embodiments of the wind driven vehicle (2) are illustrated as a water vessel or a sailboat (2') as shown in the illustrative examples of FIGS. 1 and 2; this is not intended to preclude use of embodiments of the inventive forward propulsion system (1) to propel, drive, lift, or otherwise move directly or indirectly other kinds or types of vehicles or objects, and without sacrificing the breadth of the foregoing: cars, trucks, wagons, bicycles, roller boards, roller skates, paddle boards, surf boards, and ice boats. Additionally, while the sailboat (2') shown in FIGS. 1 and 2 has a particular configuration for illustrative purposes, this is not intended to preclude the use of embodiments of the inventive sail (1) with other configurations of sailboats or water vessel configurations and the inventive sail (1) can be scaled for use with small sailboats, such as: jon boats, skiffs, dinghies, catamarans, trimarans, or pontoon boats; or scaled for use with larger sailboats, such as: ferries, yachts, megayachts, gigayachts, terayachts; or scaled for use with even larger water vessels, such as: container ships, cargo ships or passenger ships.

Figure 1:
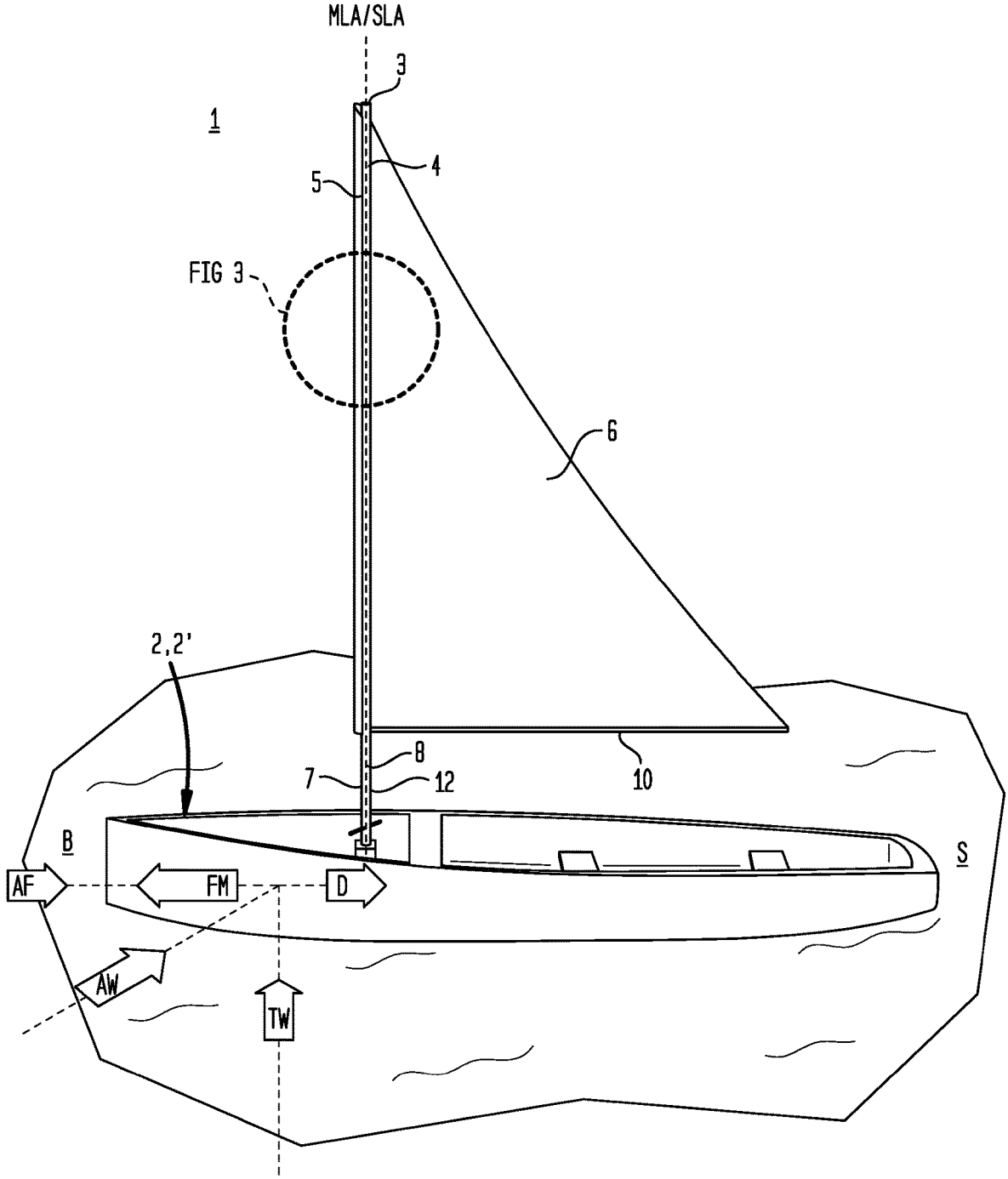

Now, with primary reference to FIGS. 1 and 2, particular embodiments of the inventive forward propulsion system (1) can include one or more of: a mast (3), a mast sleeve (4) rotatably coupled to the mast (3), a pliant sheet coupler (5) to directly or indirectly couple a pliant sheet (6) to the mast (3) or to couple the pliant sheet (6) to the mast sleeve (4) rotatably coupled to the mast (3), and a pliant sheet (6) coupled to the pliant sheet coupler (5), wherein the mast (3) or the mast sleeve (4) can rotate to dispose the pliant sheet coupler (5) toward or to the mast front (7) with the pliant sheet (6) extending over a mast first side (8) or a mast second side (9) to a connection behind the mast (3) to interact with an airflow (AF).

The term "mast" as used in accordance with the present invention means an elongate member, elongate structure, spar, pole, post, rod, or fixed wire to which a pliant sheet (6) can directly connect or indirectly couple and without sacrificing the breadth of the forgoing, includes as illustrative examples: a foremast, main mast, mizzen mast, jigger mast, pusher mast, spanker mast, jib wire, forestay, and shroud.

The term "mast sleeve" as used in accordance with particular embodiments of the present invention means a device rotatably engaged to a mast (3) to which a pliant sheet (6) can directly connect or indirectly couple and without sacrificing the breadth of the foregoing, includes as illustrative examples: a tubular member with or without bearing elements, a jib wire sleeve, and a mast hoop.

The term "pliant sheet coupler" as used in accordance with particular embodiments of the present invention means a device integral to, disposed on, or associated with a mast (3) or a mast sleeve (4) having a configuration to couple, connect or attach a pliant sheet (6) to the mast (3) or the mast sleeve (4), and without sacrificing the breadth of the foregoing, includes as illustrative examples: a pliant sheet connector on a mast hoop sail connector; a pliant sheet connector that travels in track disposed in or on a mast (3) or the mast sleeve (4).

The term "pliant sheet" as used in accordance with the present invention means a flexible material, and without sacrificing the breadth of the forgoing includes as illustrative examples, a single layer or a plurality of layers, woven or spun from, formed with, films of, or reinforced with: natural materials, such as: flax, hemp, cotton, wool, silk; or woven or spun from, formed or films of, or reinforced with: synthetic materials such as: polyester, nylon, aramid, polyethylene, polypropylene, polyethylene tetraphthalate carbon fiber, KEVLAR®, TECHNORA®, SPECTRA®, DYNEEMA®, CERTAN®, VECTRAN®; or woven or spun from, formed with or films of metal materials, such as: aluminum, beryllium, titanium, magnesium, stainless steel and alloys thereof; conventional sail materials or sails, and combinations of any of the foregoing.

Now, with primary reference to FIGS. 1 and 2, particular embodiments of the invention can include one or more of: a mast (3) or a mast sleeve (4), wherein the mast (3) or the mast sleeve (4) includes a pliant sheet coupler (5) capable of orientation at a mast front (7); and a pliant sheet (6) coupled to the pliant sheet coupler (5) of the mast (3) or the mast sleeve (4). The pliant sheet (6) coupled to the pliant sheet coupler (5) oriented at the mast front (7) can extend from the pliant sheet coupler (5) over either a mast first side (8) or a mast second side (9) to a connection behind the mast (3). In particular embodiments, the mast (3) or the mast sleeve (4) can be disposed, or rotated, to position the pliant sheet coupler (5) toward the direction of the airflow (AF) generated by the forward movement (FM) of the wind driven vessel (2), the apparent wind (AW), or generated by a combination of the apparent wind (AW) and the true wind (TW). As shown in the illustrative examples of FIGS. 2, 4A-4H, 5B and 6A-6C, the pliant sheet (6) having the pliant sheet coupler (5) oriented toward or at the mast front (7) in the direction of apparent wind (AW) allows the pliant sheet (6) to overlay a mast first side (8) or a mast second side (9) of the mast (3) and extend to a connection behind the mast (3). In particular embodiments, the pliant sheet (6) having the pliant sheet coupler (5) oriented toward at the mast front (7) can overlay a mast first side (8) or a mast second side (9) of the mast (3) and extend behind the mast (3) to a connection on a boom (10).

Now, with primary reference to FIGS. 4A through 4B, particular embodiments of the invention can include a mast (3) and a mast sleeve (4) carrying a pliant sheet coupler (5) adapted to or configured to rotate around a mast longitudinal axis (MLA) of the mast (3) in a clockwise (CW) direction as shown in the illustrative example of FIG. 4A, or a counterclockwise (CCW) direction as shown in the illustrative example of FIG. 4B, to generally orient the pliant sheet coupler (5) toward or at the mast front (7). In particular embodiments of the invention, the mast sleeve (4) can be disposed or rotated to position the pliant sheet coupler (5) toward the direction of the airflow (AF) over the sail (1) generated by forward movement (FM) of the wind driven vessel (2, 2'), the apparent wind (AW), or a combination of the apparent wind (AW) and the true wind (TW). Again, as shown in the illustrative example of FIGS. 4A through 4B, the mast sleeve (4) having the pliant sheet coupler (5) disposed generally toward or at the mast front (7), or toward the direction of forward movement (FM) of the wind driven vehicle (2) allows the pliant sheet (6) to overlay a mast first side (8) as shown in FIG. 4A, or to overlay mast second side (9) as shown in FIG. 4B, and extend to a connection behind the mast (3), or away from the direction of the apparent wind (AW), to generate a center of lift (COL) which generates forward propulsion (FP) which can create forward movement (FM) of the wind driven vehicle (2, 2').

Again, with primary reference to FIGS. 4A through 4B, in particular embodiments, the rotation of the mast (3) or the mast sleeve (4) around the mast longitudinal axis (MLA) of the mast (3) in a clockwise direction (CW) or a counterclockwise direction (CCW) to generally orient the pliant sheet coupler (5) at said mast front (7) can occur within a range of about 90 degrees to about 270 degrees relative to a zero-degree position (11) at the mast back (12) as shown in FIG. 2. This affords the substantial advantage over conventional sails of allowing the pliant sheet coupler (5) to be disposed at any radial position relative to the mast longitudinal axis (MLA) of the mast (3) regardless of the direction of the apparent wind (AW), the true wind (TW), or a combination thereof.

Again, with primary reference to FIGS. 4A through 4B, in particular embodiments the rotation of the mast (3) or the mast sleeve (4) about the mast longitudinal axis (MLA) from the zero-degree position (11) in a clockwise direction (CW) or a counterclockwise direction (CCW) may be limited to a particular range of rotation from the zero-degree position (11) at the mast back (12). In particular embodiments, the limited range of rotation from the zero-degree position in the clockwise (CW) direction or counterclockwise (CCW) direction can be about 90 degrees to about 270 degrees. In particular embodiments the rotation of the mast (3) or the mast sleeve (4) around the mast longitudinal axis (MLA) from the zero-degree position (11) in the clockwise direction (CW) or the counter-clockwise direction (CCW) can be selected from the group consisting of: about 95 degrees, about 100 degrees, about 105 degrees, about 110 degrees, about 115 degrees, about 120 degrees, about 125 degrees, about 130 degrees, about 135 degrees, about 140 degrees, about 145 degrees, about 150 degrees, about 155 degrees, about 160 degrees, about 165 degrees, about 170 degrees, about 175 degrees, about 180 degrees, about 185 degrees, about 190 degrees, about 195 degrees, about 200 degrees, about 205 degrees, about 210 degrees, about 215 degrees, about 220 degrees, about 225 degrees, about 230 degrees, about 235 degrees, about 240 degrees, about 245 degrees, about 250 degrees, about 255 degrees, about 260 degrees, about 265 degrees, and combinations thereof.

Again, with primary reference to FIG. 4A, in particular embodiments, the pliant sheet coupler (5) oriented within the range of about 90 degrees to about 270 degrees relative to the zero-degree position (11) at the mast back (12) with the pliant sheet (6) extending over the mast first side (8) to the connection behind the mast (3) can be capable of counterclockwise (CCW) rotation of up to about 540 degrees to orient the pliant sheet coupler (5) coupled to the pliant sheet at about 90 degrees to about 270 degrees relative to the zero-degree position (11) at the mast back (12) with said pliant sheet (6) extending over the mast second side (9) to the connection behind the mast (3) as shown in FIG. 4B.

Again, with primary reference to FIG. 4B, in particular embodiments, the pliant sheet coupler (5) oriented within the range of about 90 degrees to about 270 degrees relative to the zero-degree position (11) at the mast back (12) with the pliant sheet (6) extending over the mast second side (9) to the connection behind the mast (3) can be capable of clockwise (CW) rotation of up to about 540 degrees to orient the pliant sheet coupler (5) coupled to the pliant sheet (6) at about 90 degrees to about 270 degrees relative to a zero-degree position (11) at said mast back (12) with said pliant sheet (6) extending over the mast first side (8) to the connection behind the mast (3) as shown in FIG. 4A.

In particular embodiments, clockwise (CW) or counter clockwise (CCW) rotation of the mast (3) or the mast sleeve (4) to orient the pliant sheet coupler (5) within the range of about 90 degrees to about 270 degrees relative to the zero-degree position (11) at the mast back (12) from a first configuration having the pliant sheet (6) overlaying a mast first side (8) to a connection behind the mast (3) as shown in FIG. 4A toward or to a second configuration having the pliant sheet (6) overlaying a mast second side (9) to a connection behind the mast (3) as shown in FIG. 4B, or vice-versa, can be selected from the group consisting of: about 5 degrees, about 10 degrees, about 15 degrees, about 20 degrees, about 25 degrees, about 30 degrees, about 40 degrees, about 45 degrees, about 50 degrees, about 55 degrees, about 60 degrees, about 65 degrees, about 70 degrees, about 75 degrees, about 80 degrees, about 85 degrees, about 90 degrees, about 95 degrees, about 100 degrees, about 105 degrees, about 110 degrees, about 115 degrees, about 120 degrees, about 125 degrees, about 130 degrees, about 135 degrees, about 140 degrees, about 145 degrees, about 150 degrees, about 155 degrees, about 160 degrees, about 165 degrees, about 170 degrees, about 175 degrees, about 180 degrees, about 185 degrees, about 190 degrees, about 195 degrees, about 200 degrees, about 205 degrees, about 210 degrees, about 215 degrees, about 220 degrees, about 225 degrees, about 230 degrees, about 235 degrees, about 240 degrees, about 245 degrees, about 250 degrees, about 255 degrees, about 260 degrees, about 265 degrees, about 270 degrees, about 275 degrees, about 280 degrees, about 285 degrees, about 290 degrees, about 295 degrees, about 300 degrees, about 305 degrees, about 310 degrees, about 315 degrees, about 320 degrees, about 325 degrees, about 330 degrees, about 335 degrees, about 340 degrees, about 345 degrees, about 350 degrees, about 355 degrees, about 360 degrees, about 365 degrees, about 370 degrees, about 375 degrees, about 380 degrees, about 385 degrees, about 390 degrees, about 400 degrees, about 405 degrees, about 410 degrees, about 415 degrees, about 420 degrees, about 425 degrees, about 430 degrees, about 435 degrees, about 440 degrees, about 445 degrees, about 450 degrees, about 455 degrees, about 460 degrees, about 465 degrees, about 470 degrees, about 476 degrees, about 480 degrees, about 485 degrees, about 490 degrees, about 495 degrees, about 500 degrees, about 505 degrees, about 510 degrees, about 515 degrees, about 520 degrees, about 525 degrees, about 530 degrees, about 535 degrees, and combinations thereof.

Now, with primary reference to FIGS. 4A through 4H, embodiments of the mast (3) or the mast sleeve (4) rotatable about the mast longitudinal axis (MLA) of the mast (3) can have various configurations in transverse cross section of the mast longitudinal axis (MLA), each of FIGS. 4A through 4H providing an illustrative example of a mast (3) or mast sleeve (4) configuration suitable for use in particular embodiments of the invention. As shown in the illustrative examples of FIGS. 4A and 4B, the mast external surface (13) or the mast sleeve external surface (14) can be generally circular or circular in transverse cross section (15) having the mast longitudinal axis (MLA) or a sleeve rotation axis (SRA) at the center of the generally circular transverse cross section, and in which the sleeve rotation axis (SRA) may be co-incident with the mast longitudinal axis (MLA) of the mast (3). However, this example is not intended to preclude embodiments in which the mast (3) or the mast sleeve (4) is not circular or generally circular, or as to embodiments which are circular or generally circular in transverse cross section.

Now, with primary reference to FIGS. 4C through 4H and 5A and 5B, embodiments of the mast (3), or the mast sleeve (4), rotatable about the mast longitudinal axis (MLA), can have an elongate transverse cross section (16) through the mast longitudinal axis (MLA) of the mast (3), wherein the mast (3) can have a mast length (ML) greater than a mast width (MW), or the mast sleeve (4) sleeve can have a length (MSL) greater than a sleeve width (MSW), as shown in the example of FIG. 4C. Illustrative examples of an elongate mast transverse cross section (16') or elongate mast sleeve transverse cross section (16") through the mast longitudinal axis (MLA) include a mast (3) or a mast sleeve (4) having a teardrop, an ovate or a lanceolate transverse cross section having a broad end (17) tapering to a narrow end (18); however, this is not intended to preclude a mast (3) or mast sleeve 4 including a transverse cross section having different elongate configurations such as: a rectangle, a rhombus, a triangle, a stadium, a scutoid, or the like. In these embodiments, the pliant sheet (6) can connect to the pliant sheet coupler (5) disposed at or proximate the narrow end (18) of the elongate, teardrop, ovate or lanceolate transverse cross section (16). In particular embodiments, the mast (3) or the mast sleeve (4) having the elongate, teardrop, ovate or lanceolate transverse cross section, can position the mast rotation axis (MRA) or the sleeve rotation axis (SRA) proximate the broad end (17) as shown in the illustrative examples of FIGS. 4C through 4F. In particular embodiments, the mast (3) or the mast sleeve (4) having the elongate, ovate, or lanceolate transverse cross section, can position the mast rotation axis (MRA), or the sleeve rotation axis (SRA) medially between the broad end (17) and the narrow end (18) as shown in the illustrative examples of FIGS. 4G and 4H.

Now, with primary reference to FIGS. 3 and 4D through 4F, embodiments of the mast (3) or the mast sleeve (4) can have one or more airflow modifying elements (19) coupled to, disposed on, or distributed over the mast external surface (13) or the mast sleeve external surface (14); although this is not intended to preclude embodiments of the mast (3) or the mast sleeve (4) that lack airflow modifying elements (19) as shown in the illustrative example of FIG. 4C. In particular embodiments, the airflow modifying elements (19) can, but need not necessarily, be disposed over substantially the entirety or the entirety of the mast external surface (13) or the mast sleeve external surface (14), as shown in the examples of FIGS. 3 and 4D. In other particular embodiments, the airflow modifying elements (19) can be medially disposed on, or only on, the opposed sides of the mast external surface (13) or the sleeve external surface (14), as illustrated by the mast (3) or mast sleeve (4) having a teardrop, an ovate, or a lanceolate transverse cross section, shown in FIG. 4G. In other particular embodiments, the airflow modifying elements (19) shown in FIG. 4G can be disposed only on one of the opposed sides of the mast external surface (13) or the mast sleeve external surface (14) having an elongate, teardrop, ovate or a lanceolate transverse cross section. In other particular embodiments, as shown in the examples of FIGS. 4E, the airflow modifying elements (19) can be disposed on, or only on, the broad end (17) of the mast external surface (13) or the mast sleeve external surface (14) having an elongate, teardrop, ovate or lanceolate transverse cross section. In other particular embodiments, the airflow modifying elements (19) can be disposed on the broad end (17) and both opposed sides of the mast (3) or mast sleeve (4) having an ovate or lanceolate transverse cross section, as shown in the examples of FIGS. 4F through 4H.

Now, with primary reference to FIGS. 4D through 4H, embodiments in which the pliant sheet coupler (5) can be rotated toward or to the mast front (7), the pliant sheet (6) can extend from the pliant sheet coupler (5) to overlay the mast first side (8) or the mast second side (9). The pliant sheet (6) overlaying the mast first side (8) or the mast second side (9) can correspondingly overlay the airflow modifying elements (19) distributed over the mast external surface (13) or the mast sleeve external surface (14) on the pliant sheet overlaying side of the mast (3) or the mast sleeve (4) with airflow (AF) adjacent the pliant sheet forward facing side (20), while the airflow modifying elements (19) on the opposite side of the mast external surface (13) or the mast sleeve external surface (14) can remain exposed to the airflow (AF). The airflow (AF) over the airflow modifying elements (19) can generate a turbulent boundary layer (TBL) adjacent the mast external surface (13) or the mast sleeve external surface (14), as shown in the illustrative examples of FIGS. 4D through 4H (depicted in each of the Figures by the curlicue line).

Now, with primary reference to FIGS. 4A and 4B, 4D through 4H, embodiments of the airflow modifying elements (19) can vary in configuration (shape, size, depression or protrusion) or distribution over the mast external surface (13) or mast sleeve external surface (14) on the same or between embodiments of the mast (3) or the mast sleeve (4) and may be scaled depending on the application, embodiments of the airflow modifying elements (19) can all share a common purpose of generating the turbulent boundary layer (TBL) of the airflow (AF) adjacent the corresponding mast external surface (13) or mast sleeve external surface (14).

Now, with primary reference to the example of FIGS. 2, 4A and 4B and 4H, in particular embodiments, the airflow modifying elements (19) can comprise depressions (21) in the mast external surface (13) or the sleeve external surface (14). As an illustrative example, the depression(s) (21) can comprise dimple(s) including a dimple periphery defining a dimple area and a dimple configuration having a dimple depth. As an illustrative example, the dimple periphery can be generally circular or circular and the dimple configuration can be a portion of a sphere defining the dimple depth, as shown in the example of FIG. 2; however, this description is not intended to preclude other embodiments in which the dimple periphery is not generally circular or circular but can define an oval, or polygonal configurations such: a triangle, tetrahedron, rectangle, rhombus, square, trapezoid, pentagon, hexagon, heptagon, octagon, vortex generator, or other polygonal or non-polygonal configurations. The dimple configuration can further define dimples that have a dimple configuration other than a sphere. As illustrative examples, the dimple configuration can define a sphere, a truncated sphere, oval, truncated oval, a cone, a truncated cone or other polygonal or truncated polygonal configuration. In particular embodiments, the dimple configuration can further include one or more raised features extending from the dimple within the depressed area of the dimple.

Now, with primary reference to FIGS. 4D through 4G, in particular embodiments the airflow modifying elements (19) can comprise protrusions (22) on mast external surface (13) or the mast sleeve external surface (14). As an illustrative example, the protrusion(s) (22) can define a protrusion periphery defining a protrusion area and can define a protrusion height. As an illustrative example, the protrusion periphery can be generally circular or circular and have protrusion configuration being a portion of a sphere defining the protrusion height; however, this description is not intended to preclude other embodiments in which the protrusion periphery is not generally circular or circular but can define an oval, or polygonal configurations such as: a triangle, tetrahedron, rectangle, rhombus, square, trapezoid, pentagon, hexagon, heptagon, octagon, vortex generator, or other polygonal or non-polygonal configurations. The protrusion (22) configuration can further define protrusions (22) that have a protrusion configuration other than a portion of a sphere. As illustrative examples, the protrusion (22) configuration can define a sphere, a truncated sphere, oval, truncated oval, a cone, a truncated cone, or other polygonal or truncated polygonal configurations. In particular embodiments, the protrusion (22) configurations can further include one or more depressed features in the protrusion wall.

Now, with primary reference to FIGS. 5A and 5B, in particular embodiments the airflow modifying elements (19) can comprise one or more flap(s) (23) extendably-retractably coupled to the mast external surface (13) or the mast sleeve external surface (14). As shown in the example of FIG. 5A, the flap(s) (23) can be oriented toward the airflow (AF) over the mast external surface (13) or the mast sleeve external surface (14) urging the flap(s) (23) against the mast external surface (13) or the mast sleeve external surface (14). As shown in the example of FIG. 5B, the flap(s) (23) can be oriented away the airflow (AF) over the mast external surface (13) or the mast sleeve external surface (14) urging the flap(s) (23) outward of the mast external surface (13) or the mast sleeve external surface (14). The flap(s) (23) can have a flap periphery defining a square or a rectangle; however, this is not intended to preclude other configurations of the flap periphery such as: a circle, an oval, a triangle, a rhombus, a trapezoid, a pentagon, a hexagon, a septagon, an octagon, vortex generator, or other polygonal or non-polygonal configurations.

In particular embodiments, the airflow modifying elements (19) can comprise particles (24) mixed with a synthetic resin and applied to all or a portion of the mast external surface (13) or mast sleeve external surface (14) which convert into a rigid polymer upon curing. The particles (24) can comprise one or more airflow modifying elements (19) mixed with the synthetic resin and upon application to the mast external surface (13) or the mast sleeve external surface (14), and after curing, can provide a distribution of airflow modifying elements (19) as a texture or roughness to the mast external surface (13) or the mast sleeve external surface (14).

Now, with primary reference to FIGS. 6A through 6C, which illustrate examples of a plaint sheet (6) connected to pliant sheet coupler (5) facing the apparent wind (AW) generated by forward propulsion (FP) of a wind driven vehicle (2). The pliant sheet coupler (5) can be generally oriented toward to or to the mast front (7) with the pliant sheet (6) extending over the mast first side (7) or the mast second side (8) to a connection behind the mast (3), as above described. Since the airflow (AF) around the sail (1) is in motion due to forward propulsion (FP) of the wind driven vehicle (2), we can define an airflow direction (AFD) along the motion of the airflow (AF) and the component of the of the net force (F) along the airflow direction (AFD) is referred to as drag (D). A single net integrated force caused by a pressure differential on the plaint sheet (6) occurs as the center of pressure (COP) on the sail (1) having a vector direction and magnitude shown by the direction and length the arrow depicting the vector force (F).

Now, referring primarily to FIG. 6A, rotation of the plaint sheet coupler (5) toward or to the apparent wind (AW) around a mast (3) or mast sleeve (4) generally circular or circular in transverse cross section (15) to the mast longitudinal axis (MLA) with the plaint sheet (6) extending from the pliant sheet coupler (5) to a connection behind the mast (3) increases the sail thickness (ST) to form a pliant sheet curvature extending from the plaint sheet coupler (5) to the connection behind the mast (3) which can increase the pressure differential between the pliant sheet forward facing side (20) and the pliant sheet backward facing side (12) thereby increasing forward propulsion (FP).

As illustrated the airflow (AF) becomes separated into a first airflow (AF1) passing over the pliant sheet forward facing side (20) and a second airflow (AF2) passing over the mast (3) or mast sleeve (4) and the pliant sheet backward facing side (25). The pliant sheet coupler (5) disposed generally forward facing the airflow (AF) of the apparent wind (AW) passing over the mast (3) or the mast sleeve (4) can create a first airflow (AF1) passing over the plaint sheet forward facing side (20) having a first airflow velocity (V1) and the second airflow (AF2) passing over the mast external surface (13) or the mast sleeve external surface (14) and the pliant sheet backward facing side (25) can have a second airflow velocity (V2). In the illustrative examples of FIG. 5A through 5C, the position of the pliant sheet coupler (5) generally forward facing the airflow (AF) can generate a first airflow velocity (V1) of greater magnitude on the pliant sheet forward facing side (20) than the second airflow velocity (V2) on the pliant sheet backward facing side (25).

As above explained, Bernoulli's principle states that an increase in the speed of a fluid occurs simultaneously with a decrease in static pressure or a decrease in the fluid's potential energy. Therefore, if the first airflow (AF1) having the first airflow velocity (V1) flowing past the pliant sheet forward facing side (20) is moving faster than the second airflow (AF2) having the second airflow velocity (V2) flowing past the pliant sheet backward facing side (25), then according to Bernoulli's principle the pressure on the pliant sheet backward facing side (25) can be greater than on plaint sheet forward facing side (20). This pressure differential can result in a center of pressure (COP) having a vector direction toward the plaint sheet backward facing side (25). Thus, the airflow (AF) generated by the forward motion of the wind driven vehicle (2), the apparent wind (AW), can contribute to forward pulling or forward pushing of the wind driven vehicle (2, 2'), or a combination thereof.

Now, with primary reference to FIG. 6B, which illustrates a cross section transverse to a mast longitudinal axis (MLA) having a first airflow (AF1) and a second airflow (AF2) moving over a mast (3) or a mast sleeve (4) having an elongate transverse cross section (16) with the pliant sheet coupler (5) rotatable in clockwise direction (CW) or counterclockwise direction (CCW) around the mast longitudinal axis (MLA) toward or to the direction of the apparent wind (AW). The mast (3) or mast sleeve (4) having an elongate transverse cross section (14) disposes the pliant sheet coupler (5) further toward the windward side of the wind driven vehicle (2) which can move the center of lift (COL) toward the bow (B) of the wind driven vehicle (2) to further increase the pressure differential between the pliant sheet forward facing side (20) and the pliant sheet backward facing side (25), thereby further increasing forward propulsion (FP) compared to the embodiment shown in FIG. 6A. Again, as above described, the pliant sheet coupler (5) disposed generally forward facing the airflow (AF) passing over the mast (3) or the mast sleeve (4) can create a first airflow (AF1)

passing over the pliant sheet forward facing side (20) having a first airflow velocity (V1) and a second airflow (AF2) passing over the pliant sheet backward facing side (25) having a second airflow velocity (V2). The mast (3) or the mast sleeve (4) of the illustrative example of FIG. 6B having the elongate, teardrop, ovate or lanceolate configuration in transverse cross section to the mast longitudinal axis (MLA) of the mast (3) can present a streamline of the mast external surface (13) or the mast sleeve external surface (14) opposite the pliant sheet facing side of the mast (3) which can delay separation of the second airflow (AF2) from the mast external surface (13) or sleeve external surface (14) which can result a further reduction in second airflow velocity (V2) of the second airflow (AF2) relative to the first airflow velocity of the first airflow (AF1), or a reduction in drag (D), or a combination thereof, which can shift the direction of the center of lift (COL) further forward toward the pliant sheet coupler (5) or increase the magnitude of force at the center of lift (COL), or a combination thereof, on the pliant sheet backward facing side (25) of the pliant sheet (6).

Now, with primary reference to FIG. 6C, which illustrates an embodiment having a pliant sheet coupler (5) facing the apparent wind (AW) generated by forward motion of the wind driven vehicle (2) with the pliant sheet (6) extending from the pliant sheet coupler (5) overlaying either the mast first side (7) or the mast second side (8) to a connection behind the mast (3). Again, as described above, the pliant sheet coupler (5) disposed generally forward facing the airflow (AF) passing over the mast (3) or the mast sleeve (4) can create a first airflow (AF1) passing over the pliant sheet forward facing side (20) having a first airflow velocity (V1) and a second airflow (AF2) passing over the mast external surface (13) or sleeve external surface (14) having a second airflow velocity (V2). The mast external surface (13) or the mast sleeve external surface (14) having an elongate, teardrop, ovate or lanceolate configuration in transverse cross section to the mast longitudinal axis (MLA) of the mast (3) can further include airflow modifying elements (19) distributed over the mast external surface (13) or the mast sleeve external surface (14). The streamline of the mast external surface (13) or the mast sleeve external surface (14) having airflow modifying elements (19) disposed on mast external surface (13) or the mast sleeve external surface (14) opposite the mast external surface (13) or the mast sleeve external surface (14) overlaid by the pliant sheet (6) can generate a turbulent boundary layer (TBL) adjacent the mast external surface (13) or the mast sleeve external surface (14) opposite the mast external surface (13) or the mast sleeve external surface (14) overlaid by the pliant sheet (6). The turbulent boundary layer (TBL) can further delay separation of the second airflow (AF2) from the mast external surface (13) or the mast sleeve external surface (14) as compared to the illustrative examples of FIGS. 6A and 6B. The delayed separation of the second airflow (AF2) from the mast external surface (13) or the mast sleeve external surface (14) opposite the sail facing side of the mast (3) or mast sleeve (4) can result in a further reduction in second airflow velocity (V2) of second airflow (AF2) relative to the first airflow velocity (V1) of the first airflow (AF1) or a reduction in drag (D), or a combination thereof, which can shift the direction of the center of lift (COL) further forward toward the pliant sheet coupler (5) or increase the magnitude of force at the center of lift (COL), or a combination thereof.

Now, with primary reference to FIGS. 7A and 7B, which compare the vector forces generated on the embodiment of FIG. 7A including pliant sheet (6) having the pliant sheet coupler (5) disposed at the mast back (12) with the pliant sheet (6) extending from the pliant coupler (5) to a connection behind the mast (3) and the vector forces generated on the embodiment of FIG. 7B including a pliant sheet (6) having the pliant coupler (5) disposed at the mast front (7) with the pliant sheet (6) extending from the pliant sheet coupler (5) and overlaying the mast first side (8) or the mast second side (9) to a connection behind the mast (3).

The embodiment of FIG. 7A having an associated force of 4448 Newtons (1000 pounds) can generate a force vector at an angle of about 50 degrees relative to the forward propulsion (FP) of the wind driven vehicle (2) which can develop 2856 Newtons (642 pounds) of force in the direction of the forward propulsion (FP) and can develop a tipping force (TF) perpendicular to the direction of forward propulsion (FP) of 3852 Newtons (766 pounds).

By comparison embodiments of the invention as illustrated by FIG. 7B, having an associated force of 4448 Newtons (1000 pounds) can generate a force vector at an angle of about 30 degrees relative to the forward propulsion (FP) of the wind driven vehicle (2) which can develop 3852 Newtons (866 pounds) of force in the direction of the forward propulsion (FP) and can develop a tipping force (TF) perpendicular to the direction of forward propulsion (FP) of 2224 Newtons (500 pounds).

As can be easily understood from the foregoing, the basic concepts of the present invention may be embodied in a variety of ways. The invention involves numerous and varied embodiments of a sail and methods for making and using such sail including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "coupler" should be understood to encompass disclosure of the act of "coupling"—whether explicitly discussed or not—and, conversely, were there is a disclosure of the act of "coupling", such a disclosure should be understood to encompass disclosure of a "coupler" and even a "means for coupling". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the forward propulsion systems, sail configurations, or mast-sail configurations herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The elements following an open transitional phrase such as "comprising" may in the alternative be claimed with a closed transitional phrase such as "consisting essentially of" or "consisting of" whether or not explicitly indicated the description portion of the specification.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A forward propulsion system for a wind driven vehicle, comprising:

a mast including a pliant sheet coupler, said mast rotatable to orient said pliant sheet coupler at a mast front; and a pliant sheet coupled to said pliant sheet coupler oriented at said mast front, said pliant sheet extending from said pliant sheet coupler oriented at said mast front over either a mast first side or a mast second side to a connection behind said mast.

2. The system of claim 1, further comprising a mast sleeve carrying said pliant sheet coupler, said mast or said mast sleeve adapted to rotate around a mast longitudinal axis of said mast in a clockwise direction or a counterclockwise direction to generally orient said pliant sheet coupler at said mast front.

3. The system of claim 2, wherein rotation of said mast or said mast sleeve around said mast longitudinal axis of said mast in said clockwise or said counterclockwise direction to generally orient said pliant sheet coupler at said mast front allows said pliant sheet coupled to said pliant sheet coupler to extend either over said mast first side or said mast second side to said connection behind said mast.

4. The system of claim 3, wherein said rotation of said mast or said mast sleeve around said mast longitudinal axis of said mast in said clockwise direction or said counterclockwise direction to generally orient said pliant sheet coupler at said mast front occurs within a range of about 90 degrees to about 270 degrees relative to a zero-degree position at a mast back.

5. The system of claim 4, wherein said pliant sheet coupler oriented within said range of about 90 degrees to about 270 degrees relative to said zero-degree position at said mast back with said pliant sheet extending over said mast first side to said connection behind said mast capable of clockwise rotation of up to about 540 degrees to orient said pliant sheet coupler coupled to said pliant sheet at about 90 degrees to about 270 degrees relative to said zero-degree position at said mast back with said pliant sheet extending over said mast second side to said connection behind said mast.

6. The system of claim 4, wherein said pliant sheet coupler oriented within said range of about 90 degrees to about 270 degrees relative to said zero-degree position at said mast back with said pliant sheet extending over said mast second side to said connection behind said mast capable of counterclockwise rotation of up to about 540 degrees to orient said pliant sheet coupler coupled to said pliant sheet at about 90 degrees to about 270 degrees relative to said zero degree position at said mast back with said pliant sheet extending over said mast first side to said connection behind said mast.

7. The system of claim 3, wherein said rotation of said mast or said mast sleeve in said clockwise direction or said counterclockwise direction around said mast longitudinal axis of said mast orients said pliant sheet coupler toward an apparent wind generated by forward propulsion of said wind driven vehicle.

8. The system of claim 3, wherein said pliant sheet coupler coupled to said pliant sheet oriented at about 90 degrees to about 270 degrees relative to a 0 degree position at a mast back with said pliant sheet extending over a mast first side or a mast second side to said connection behind said mast generates a pliant sheet configuration in which airflow over a pliant sheet forward facing side has greater airflow velocity than said airflow velocity over a pliant sheet backward facing side, wherein air pressure on said pliant sheet backward facing side is greater than said air pressure on said pliant sheet forward facing side.

9. The system of claim 2, wherein said mast or said mast sleeve having a generally circular or circular transverse cross section through said mast longitudinal axis of said mast.

10. The system of claim 2, where said mast or said mast sleeve having an elongate transverse cross section through said mast longitudinal axis of said mast, wherein said mast or said mast sleeve having a mast sleeve length greater than a mast sleeve width.

11. The system of claim 10, wherein said mast or said mast sleeve having a teardrop, an ovate or a lanceolate transverse cross section through said mast longitudinal axis of said mast.

12. The system of claim 11, wherein said teardrop, said ovate or said lanceolate transverse cross section of said mast or said mast sleeve each define a broad end opposite a narrow end, said broad end having greater width than said narrow end, wherein said pliant sheet coupler disposed proximate said narrow end of said mast or said mast sleeve.

13. The system of claim 12, wherein said mast or said mast sleeve having said ovate or said lanceolate transverse cross section through said mast longitudinal axis of said mast rotates in said clockwise direction or said counterclockwise direction around said mast longitudinal axis of said mast disposed proximate said broad end of said ovate or lanceolate transverse cross section through said mast longitudinal axis of said mast.

14. The system of claim 12, wherein said mast or said mast sleeve having said ovate or said lanceolate transverse cross section through said mast longitudinal axis of said mast rotates in said clockwise direction or said counterclockwise direction around said mast longitudinal axis of said mast disposed medially between said broad end and said narrow end of said ovate or lanceolate transverse cross section through said mast longitudinal axis of said mast.

15. A forward propulsion system for a wind driven vehicle, comprising:

a mast or mast sleeve disposed about said mast including a pliant sheet coupler, said mast or said mast sleeve rotatable to orient said pliant sheet coupler at a mast front; and a pliant sheet coupled to said pliant sheet coupler oriented at said mast front, said pliant sheet extending from said pliant sheet coupler oriented at said mast front over either a mast first side or a mast second side to a connection behind said mast; and one or more airflow modifying elements distributed over a mast external surface of said mast or a mast sleeve external surface of said mast sleeve, said airflow modifying elements configured to generate a turbulent boundary layer in an airflow adjacent said mast external surface of said mast or said mast sleeve external surface of said mast sleeve.

16. The system of claim 15, wherein rotation of said mast or said mast sleeve around said mast longitudinal axis of said mast in said clockwise direction or said counterclockwise direction orients said pliant sheet coupler to or toward said mast front, wherein said pliant sheet coupled to said pliant sheet coupler overlays said airflow modifying elements distributed over said mast first side or said mast second side of said mast, said airflow modifying elements remaining exposed opposite said mast first side or said mast second side overlaid by said pliant sheet generates said turbulent boundary layer in said airflow adjacent said mast external surface or said mast sleeve external surface opposite said mast first side or said mast second side overlaid by said pliant sheet.

17. The system of claim 15, wherein said airflow modifying elements disposed over substantially the entirety of said mast external surface of said mast or said mast sleeve external surface of said mast sleeve.

18. The system of claim 15, wherein said mast or said mast sleeve having a circular, a teardrop, an ovate, or a lanceolate transverse cross section through said mast longitudinal axis of said mast, wherein said airflow modifying elements medially disposed on opposed sides of said mast external surface or said mast sleeve external surface having said circular, said teardrop, said ovate, or said lanceolate transverse cross section through said mast longitudinal axis of said mast.

19. The system of claim 15, wherein said mast or said mast sleeve having a teardrop, an ovate or a lanceolate transverse cross section through said mast longitudinal axis of said mast, wherein said teardrop, said ovate or said lanceolate transverse cross section of said mast or said mast sleeve each define a broad end opposite a narrow end, said broad end having greater width than said narrow end, wherein said airflow modifying elements disposed on said broad end of said mast or said mast sleeve having said teardrop, said ovate, or said lanceolate transverse cross section through said mast longitudinal axis.

20. The system of claim 15, wherein said airflow modifying elements comprise depressions in said mast or mast sleeve external surface.

21. The system of claim 15, wherein said airflow modifying elements comprise protrusions in said mast or mast sleeve external surface.

22. The system of claim 15, wherein said airflow modifying elements outwardly extend from said mast external surface or said mast sleeve external surface when said pliant sheet coupler has an orientation upwind of said airflow modifying elements to generate said turbulent boundary layer in said airflow adjacent said mast external surface or said mast sleeve external surface, and wherein said airflow modifying elements lie adjacent said mast external surface or said mast sleeve external surface when said pliant sheet coupler has an orientation downwind of said airflow modifying elements to avoid generation of said turbulent boundary layer in said airflow adjacent said mast external surface or said mast sleeve external surface.

23. The system of claim 3, further comprising:

a mast or mast sleeve disposed about said mast including a pliant sheet coupler, said mast or said mast sleeve rotatable to orient said pliant sheet coupler at a mast front; and a pliant sheet coupled to said pliant sheet coupler oriented at said mast front, said pliant sheet extending from said pliant sheet coupler oriented at said mast front over either a mast first side or a mast second side to a connection behind said mast; and one or more airflow modifying elements distributed over a mast external surface or said mast sleeve external surface, said airflow modifying elements configured to generate a turbulent boundary layer in said airflow adjacent said mast external surface or said mast sleeve external surface to delay separation of said airflow moving over said mast external surface or said mast sleeve external surface to reduce said airflow velocity over a pliant sheet backward facing side, wherein reduction of said airflow velocity on said pliant sheet backward facing side increases air pressure on said pliant sheet backward facing side.

* * * * *